US008653350B2

(12) United States Patent
Takahashi et al.

(10) Patent No.: US 8,653,350 B2
(45) **Date of Patent: *Feb. 18, 2014**

(54) PERFORMANCE APPARATUS AND ELECTRONIC MUSICAL INSTRUMENT

(75) Inventors: Hiroki Takahashi, Ome (JP); Takahiro Mizushina, Kawagoe (JP)

(73) Assignee: Casio Computer Co., Ltd., Tokyo (JP)

( * ) Notice: Subject to any disclaimer, the term of this patent is extended or adjusted under 35 U.S.C. 154(b) by 342 days.

This patent is subject to a terminal disclaimer.

(21) Appl. No.: 13/118,643

(22) Filed: May 31, 2011

(65) Prior Publication Data

US 2011/0290097 A1 Dec. 1, 2011

(30) Foreign Application Priority Data

Jun. 1, 2010 (JP) ..... 2010-125713
Jun. 8, 2010 (JP) ..... 2010-130623

(51) Int. Cl.
*G10H 1/18* (2006.01)

(52) U.S. Cl.
USPC ..... 84/615; 84/653

(58) Field of Classification Search
USPC ..... 84/600–602, 615, 653
See application file for complete search history.

(56) References Cited

U.S. PATENT DOCUMENTS 5,003,859 A * 4/1991 Monte et al. ..... 84/423 R
5,018,427 A * 5/1991 Uchiyama ..... 84/603
5,024,134 A * 6/1991 Uchiyama ..... 84/654
5,058,480 A 10/1991 Suzuki et al.
5,115,705 A * 5/1992 Monte et al. ..... 84/617
5,942,709 A * 8/1999 Szalay ..... 84/616
6,198,034 B1 * 3/2001 Beach et al. ..... 84/600
8,426,717 B2 * 4/2013 Okuyama et al. ..... 84/624
2003/0005815 A1 * 1/2003 Bruti et al. ..... 84/615
2004/0011189 A1 * 1/2004 Ishida et al. ..... 84/626
2005/0098021 A1 * 5/2005 Hofmeister et al. ..... 84/453
2006/0144212 A1 * 7/2006 Hofmeister et al. ..... 84/724
2006/0185502 A1 * 8/2006 Nishitani et al. ..... 84/615
2008/0060502 A1 3/2008 Hasebe
2010/0263518 A1 * 10/2010 Nishitani et al. ..... 84/612

FOREIGN PATENT DOCUMENTS

CN 101140757 A 3/2008
CN 201069642 Y 6/2008
JP 2663503 B2 6/1997

OTHER PUBLICATIONS

Chinese Office Action dated May 30, 2012 (and English translation thereof) in counterpart Chinese Application No. 201110146130.2.

* cited by examiner

*Primary Examiner* — David S. Warren
(74) *Attorney, Agent, or Firm* — Holtz, Holtz, Goodman & Chick, PC

(57) ABSTRACT

A performance apparatus 11 extends in a longitudinal direction to be held by a player, and is provided with an acceleration sensor 23. CPU 21 of the performance apparatus 11 gives a sound source unit 31 of a musical instrument unit 19 an instruction (note-on event) to generate a musical tone. CPU 21 generates a note-on event indicating a sound-generation timing represented by a time when an acceleration-sensor value of the acceleration sensor 23 exceeds a first predetermined value and thereafter has decreased to a value less than a second threshold value β, which is less than a first threshold value α, and gives the musical instrument unit 19 the generated note-on event to generate a musical tone.

14 Claims, 20 Drawing Sheets

1000

| θd | −180≦θd<−θ1 | −θ1≦θd<0 | 0≦θd<θ1 | θ1≦θd<180 |
|---|---|---|---|---|
| PITCH | P1 | P2 | P3 | P4 |

| $\theta d$ | $-180 \leqq \theta d < -\theta 1$ | $-\theta 1 \leqq \theta d < 0$ | $0 \leqq \theta d < \theta 1$ | $\theta 1 \leqq \theta d < 180$ |
|---|---|---|---|---|
| TIMBRE | FLOOR TOM | LOW TOM | HIGH TOM | CYMBAL |

PERFORMANCE APPARATUS AND ELECTRONIC MUSICAL INSTRUMENT

CROSS REFERENCE TO RELATED APPLICATIONS

The present application is based upon and claims the benefit of priority from the prior Japanese Patent Application No. 2010-125713, file Jun. 1, 2010, and Japanese Patent Application No. 2010-120623, filed Jun. 8, 2010, and the entire contents of which are incorporated herein by reference.

BACKGROUND OF THE INVENTION

1. Field of the Invention

The present invention relates to a performance apparatus and an electronic musical instrument, which generate musical tones, when a player holds with his or her hand and swings the performance apparatus.

2. Description of the Related Art

An electronic musical instrument has been proposed, which has an elongated member of a stick type with a sensor provided thereon, and generates musical tones when the sensor detects the motion of the elongated member. The elongated member of a stick type has a shape of a drumstick, and the musical instrument is constructed so as to generate musical tones as if percussion instruments generate sounds in response to a player's motion to strike drums.

Japanese Patent No. 2,663,503 discloses a performance apparatus, which has a member of a stick type with an acceleration sensor provided thereon, and generates a musical tone when a certain of time passes by after an output (acceleration sensor value) of the acceleration sensor reaches a predetermined threshold value.

The player holds the one end of the elongated performance apparatus of a stick type with his or her hand, and for instance, swings the performance apparatus down. In practical drum performance, when the player swings the drumstick down, he or she sometimes hits the surface of the drum hard with the highest swinging-down speed, but frequently swings the drumstick down to the lowest position to hit the drum so as to quickly swing the drumstick up to move to the following motion. Therefore, it is preferable for the electronic musical instrument to generate musical tones at the moment the elongated performance apparatus has been swung down to the lowest position.

But it is difficult for the performance apparatus disclosed in Japanese Patent No. 2,663,503 to generate musical tones at the moment said performance apparatus has been swung down to the lowest position.

SUMMARY OF THE INVENTION

The present invention has an object to provide a performance apparatus and an electronic musical instrument, which is able to generate a musical tone at a timing desired by a player without failure.

According to one aspect of the invention, there is provided a performance apparatus to be used with a musical-tone generating device for generating a musical tone, which apparatus comprises a holding member extending in a longitudinal direction to be held by a player, an acceleration sensor provided in the holding member, for obtaining an acceleration-sensor value, and controlling means for giving the musical-tone generating device an instruction of generating a sound, wherein the controlling means comprises sound-generation timing detecting means for giving an instruction to the musical-tone generating device to generate a musical tone at a sound-generation timing represented by a time when the acceleration-sensor value obtained by the acceleration sensor has decreased to a value less than a second threshold value after increasing to a value larger than a first threshold value, wherein the second threshold value is less than the first threshold value.

According to another aspect of the invention, there is provided an electronic musical instrument, which comprises a musical instrument unit and a performance apparatus, wherein the musical instrument unit comprises musical-tone generating device for generating musical tones, and the performance apparatus comprises a holding member extending in a longitudinal direction to be held by a player, an acceleration sensor provided in the holding member, for obtaining an acceleration-sensor value, and controlling means for giving an instruction of generating a sound to the musical-tone generating device, wherein the controlling means comprises sound-generation timing detecting means for giving an instruction to the musical-tone generating device to generate a musical tone at a sound-generation timing represented by a time when the acceleration-sensor value obtained by the acceleration sensor has decreased to a value less than a second threshold value after increasing to a value larger than a first threshold value, the second threshold value being less than the first threshold value, and wherein both the musical instrument unit and the performance apparatus comprise communication means, respectively.

BRIEF DESCRIPTION THE DRAWINGS

Figure 9A:
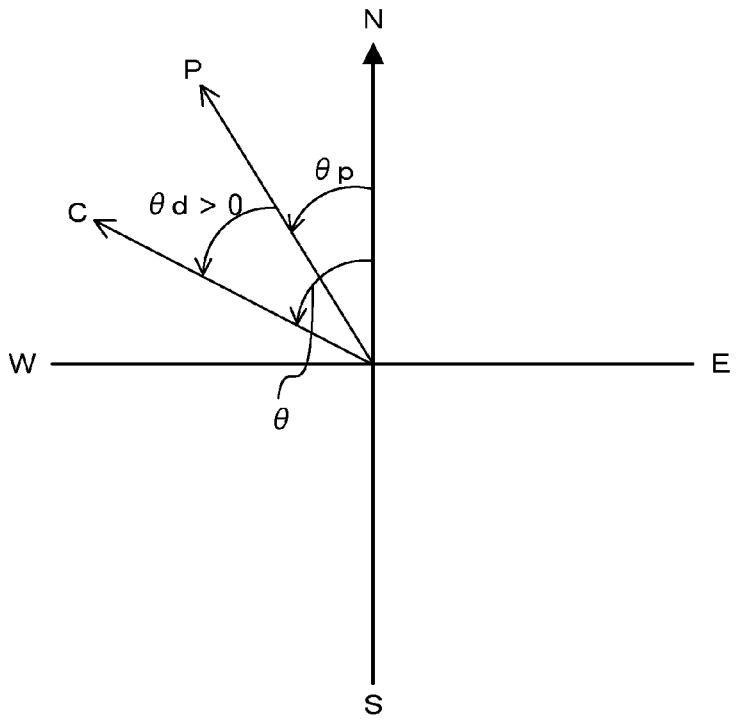
Figure 9B:
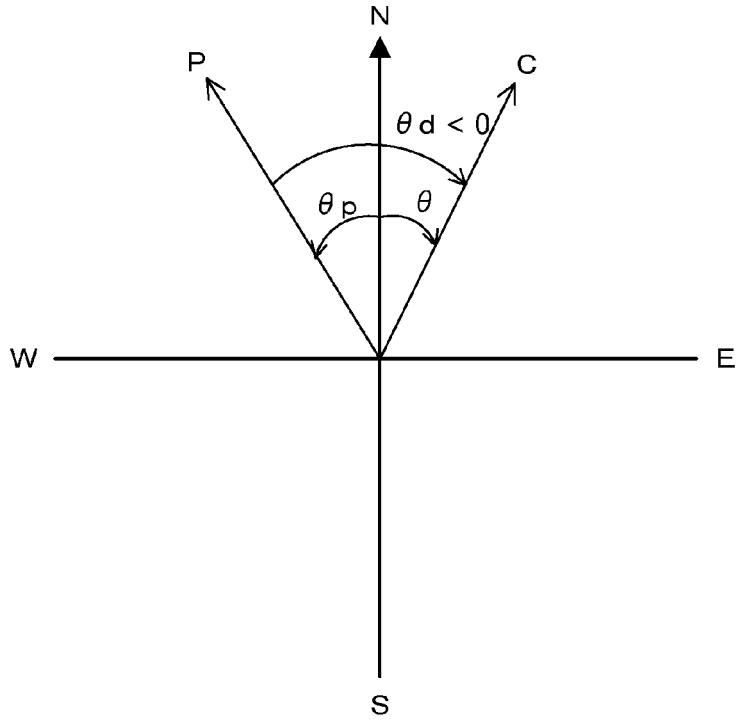

FIG. 9*a* and FIG. 9*b* are views for explaining the difference value θd.

Figures 10A, 10B:
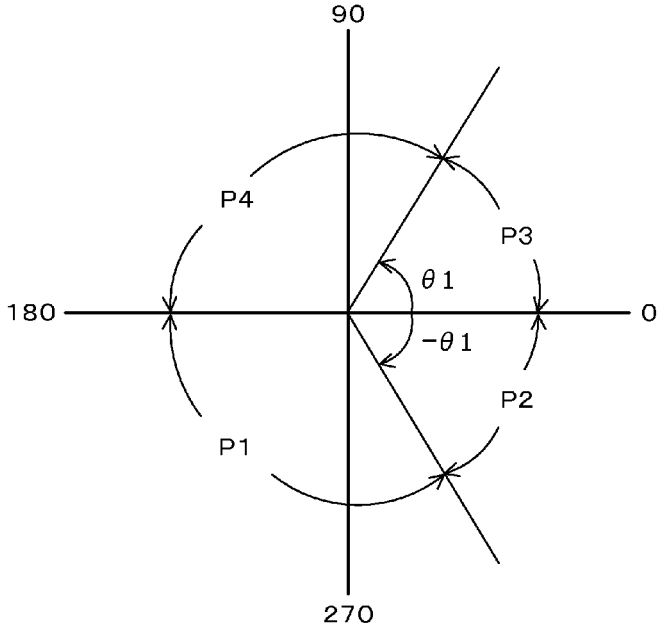

FIG. 10*a* is a view showing an example of a table, which associates ranges of the difference values θd with pitches of musical tones of percussion instruments, respectively.

FIG. 10*b* is a view schematically showing relationship between pitches of musical tones and ranges, in which the performance apparatus 11 is swung by the player as if he or she beats drums and other percussion instruments.

Figure 11:
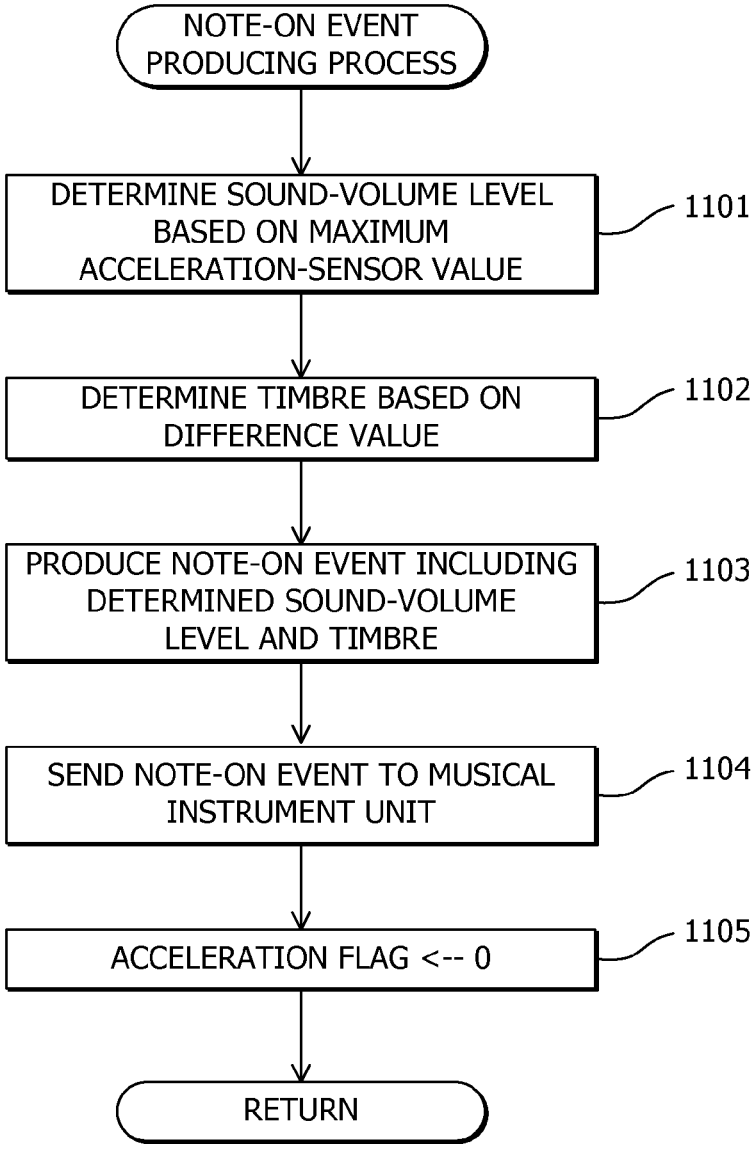

FIG. 11 is a flow chart of an example of a note-on event producing process performed in the second embodiment.

Figures 12A, 12B:
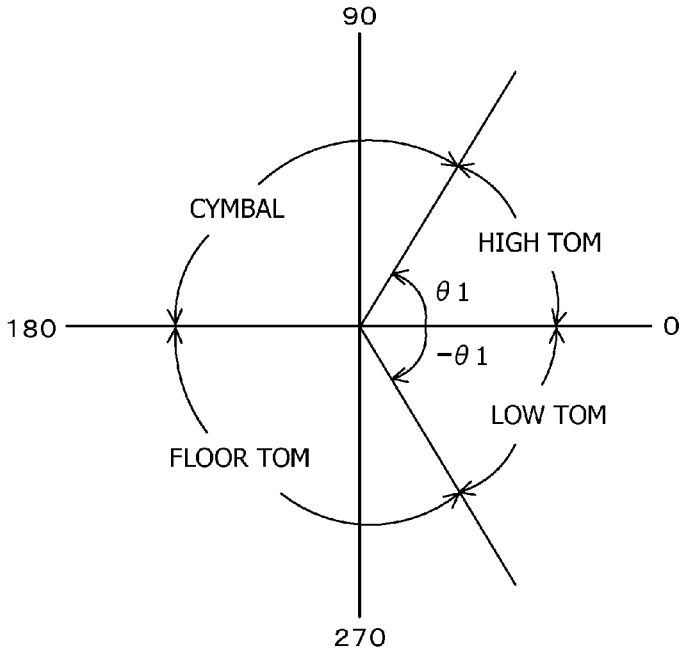

FIG. 12*a* is a view of an example of a table, which associates the ranges of the difference values θd with timbres of musical tones of the percussion instruments, respectively.

FIG. 12*b* is a view schematically showing relationship between timbres of musical tones and ranges, in which the performance apparatus 11 is swung by the player as if he or she beats drums and other percussion instruments.

Figure 13:
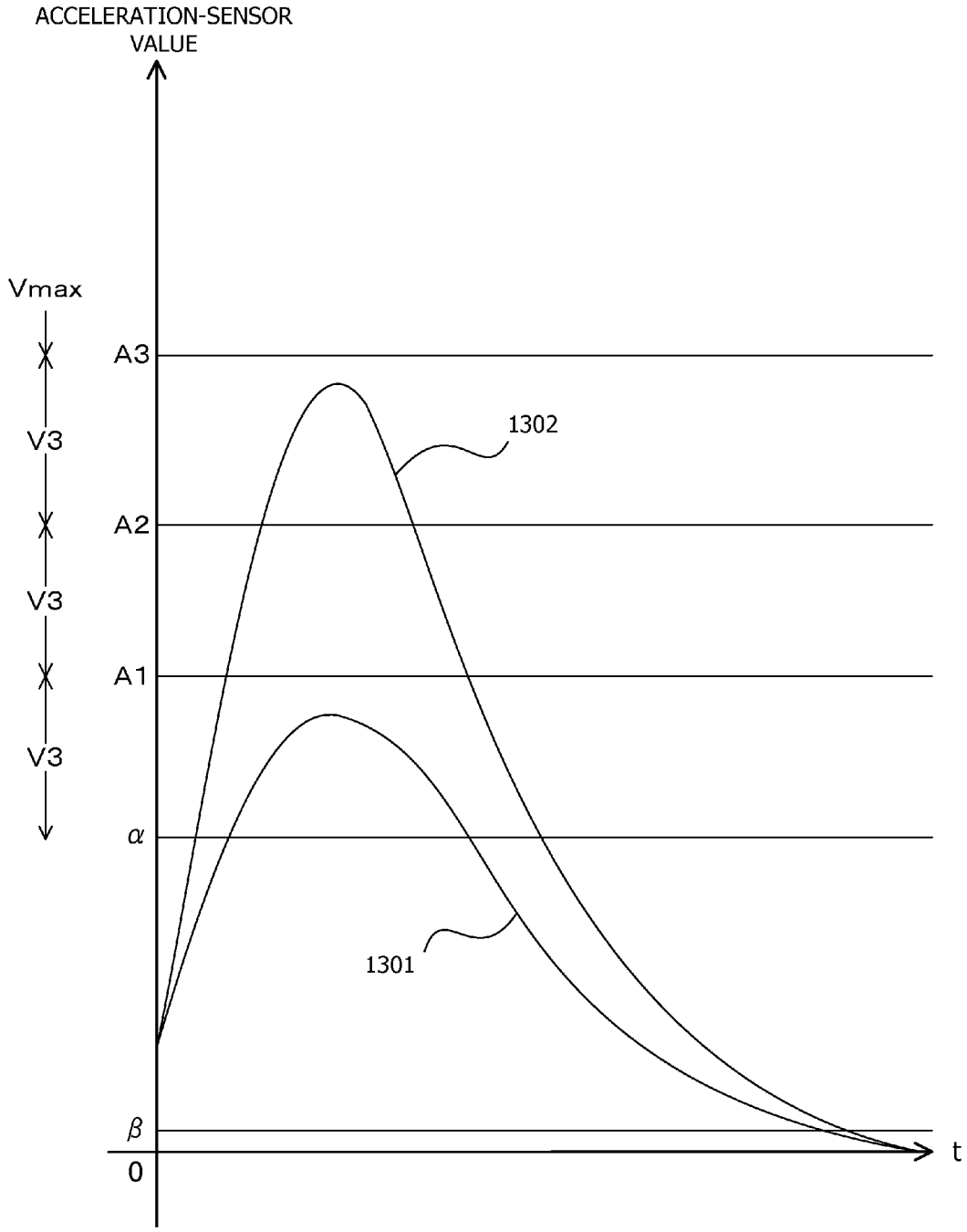

FIG. 13 is a graph for describing relationship between the sound volume levels (velocity) and the corresponding ranges of the maximum values Amax of the acceleration-sensor values.

Figure 14:
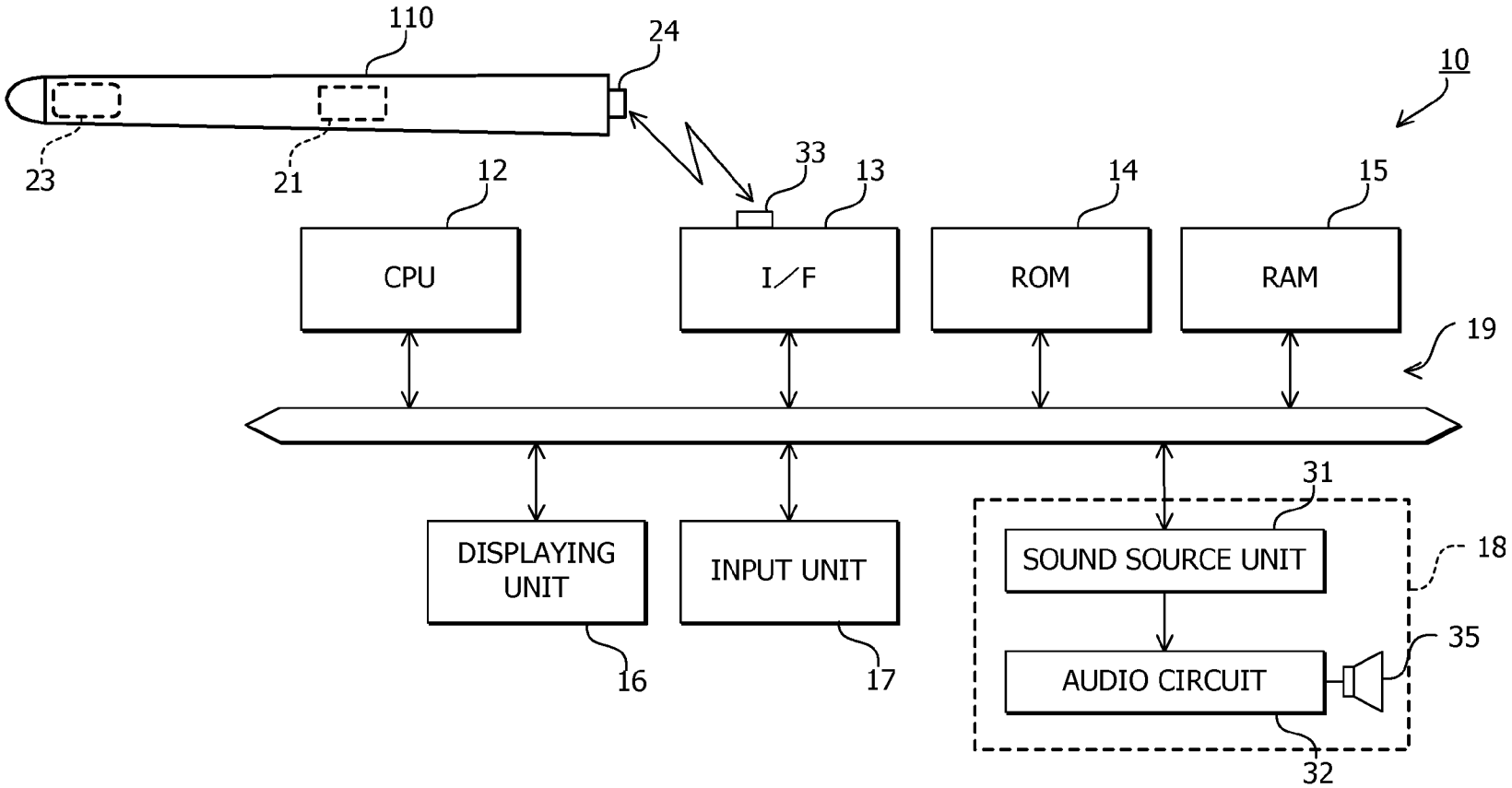

FIG. 14 is a block diagram of a configuration of an electronic musical instrument according to the forth embodiment of the invention.

Figure 15:
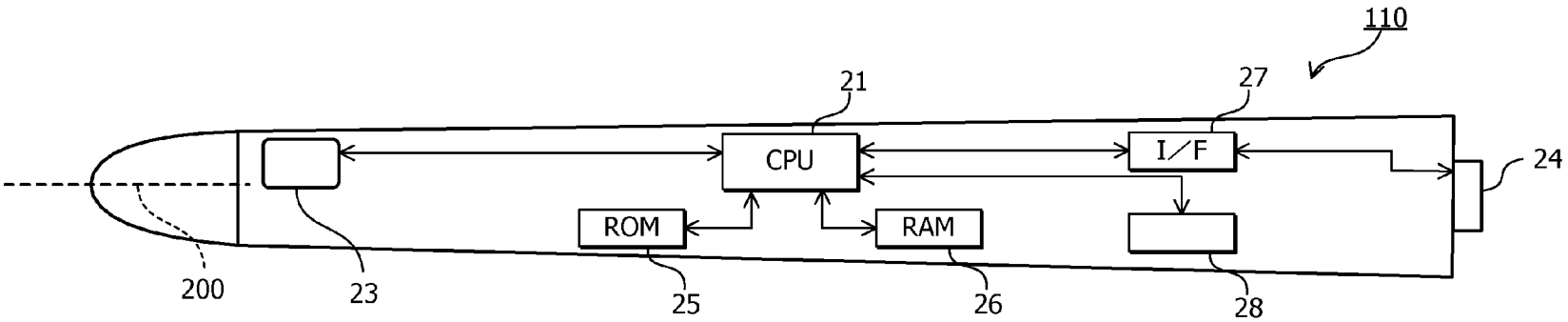

FIG. 15 is a block diagram of a configuration of a performance apparatus in the fourth embodiment.

Figure 16A:
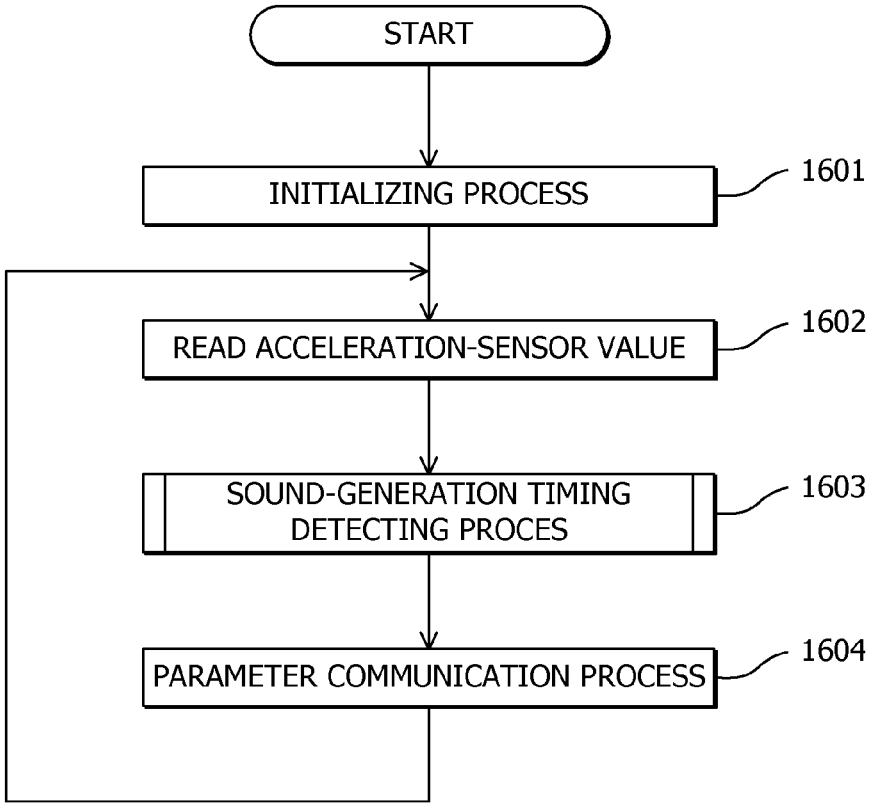

FIG. 16*a* is a flow chart of an example of a process performed in the performance apparatus according to the fourth embodiment.

Figure 16B:
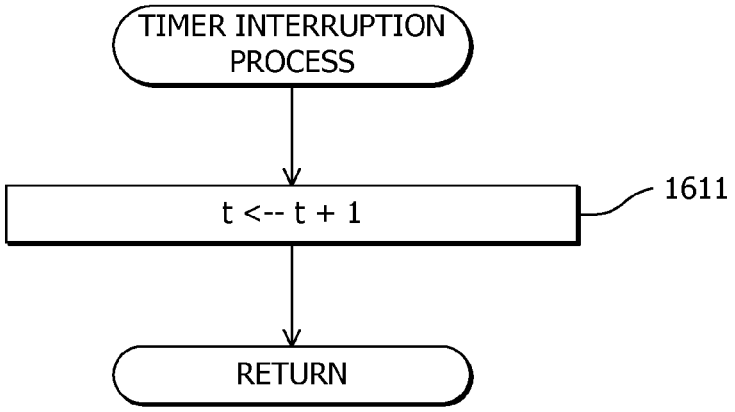

FIG. 16*b* is a flow chart of an example of a timer interruption process performed in the performance apparatus according to the fourth embodiment.

Figure 17:
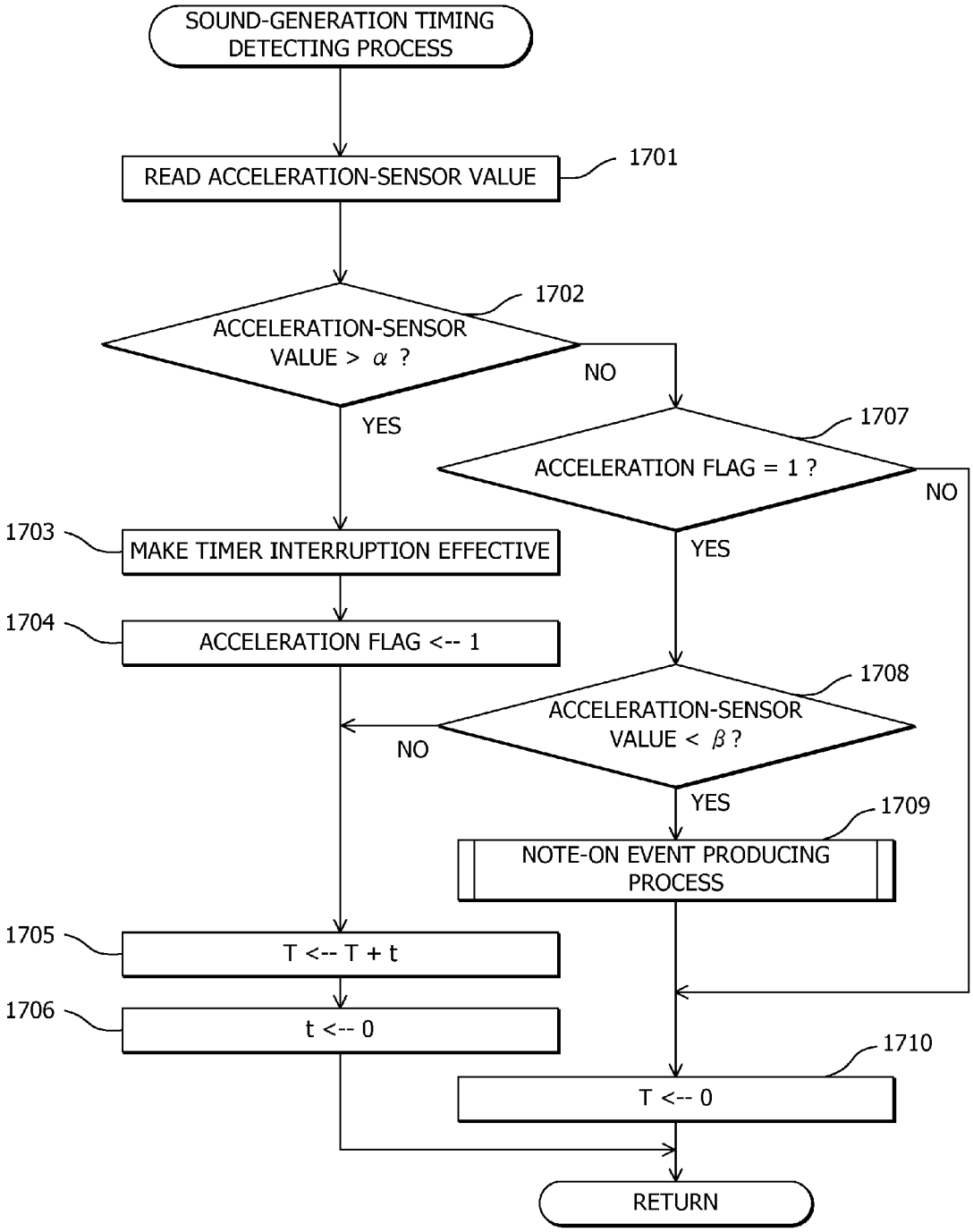

FIG. 17 is a flow chart of an example of a sound-generation timing detecting process performed in the fourth embodiment.

Figure 18:
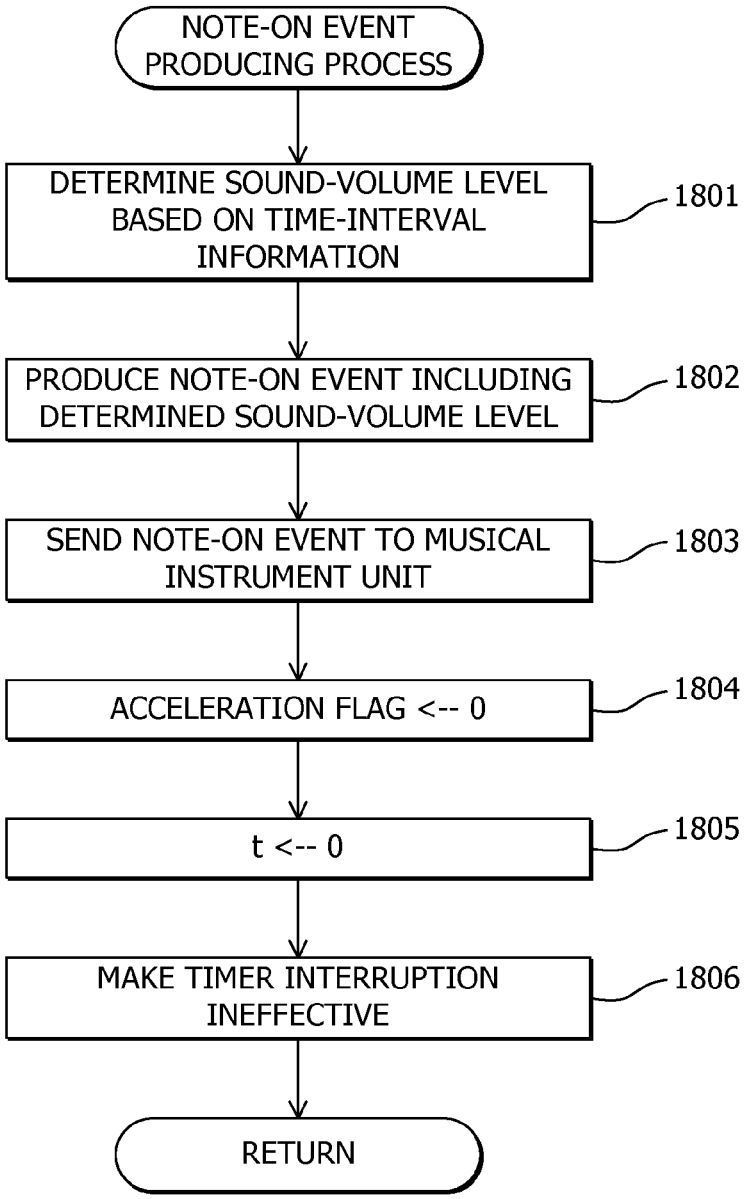

FIG. 18 is a flow chart of an example of a note-on event producing process performed in the fourth embodiment.

Figure 19:
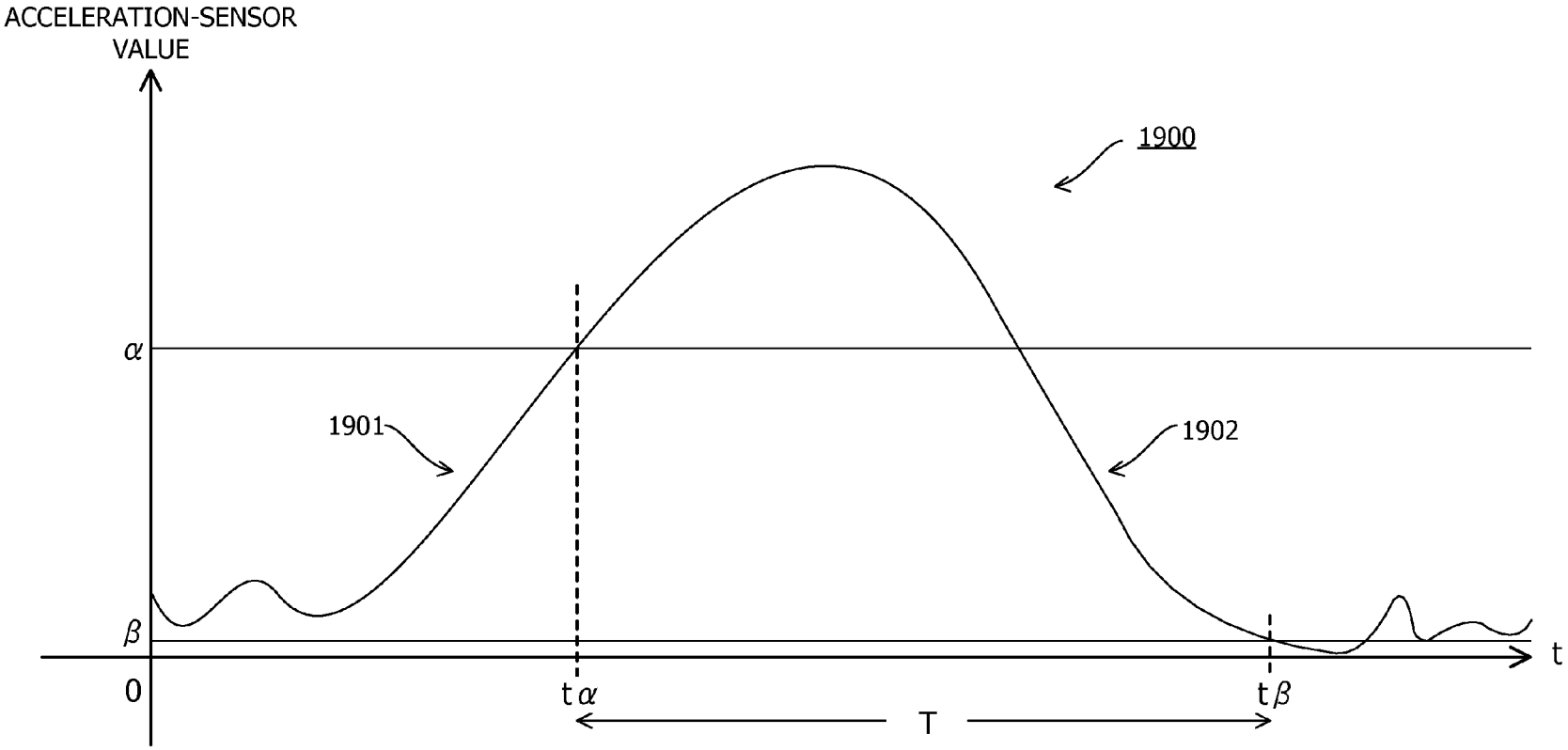

FIG. 19 is a graph that typically represents an acceleration-sensor value detected by an acceleration sensor of the performance apparatus according to the fourth embodiment.

Figure 20:
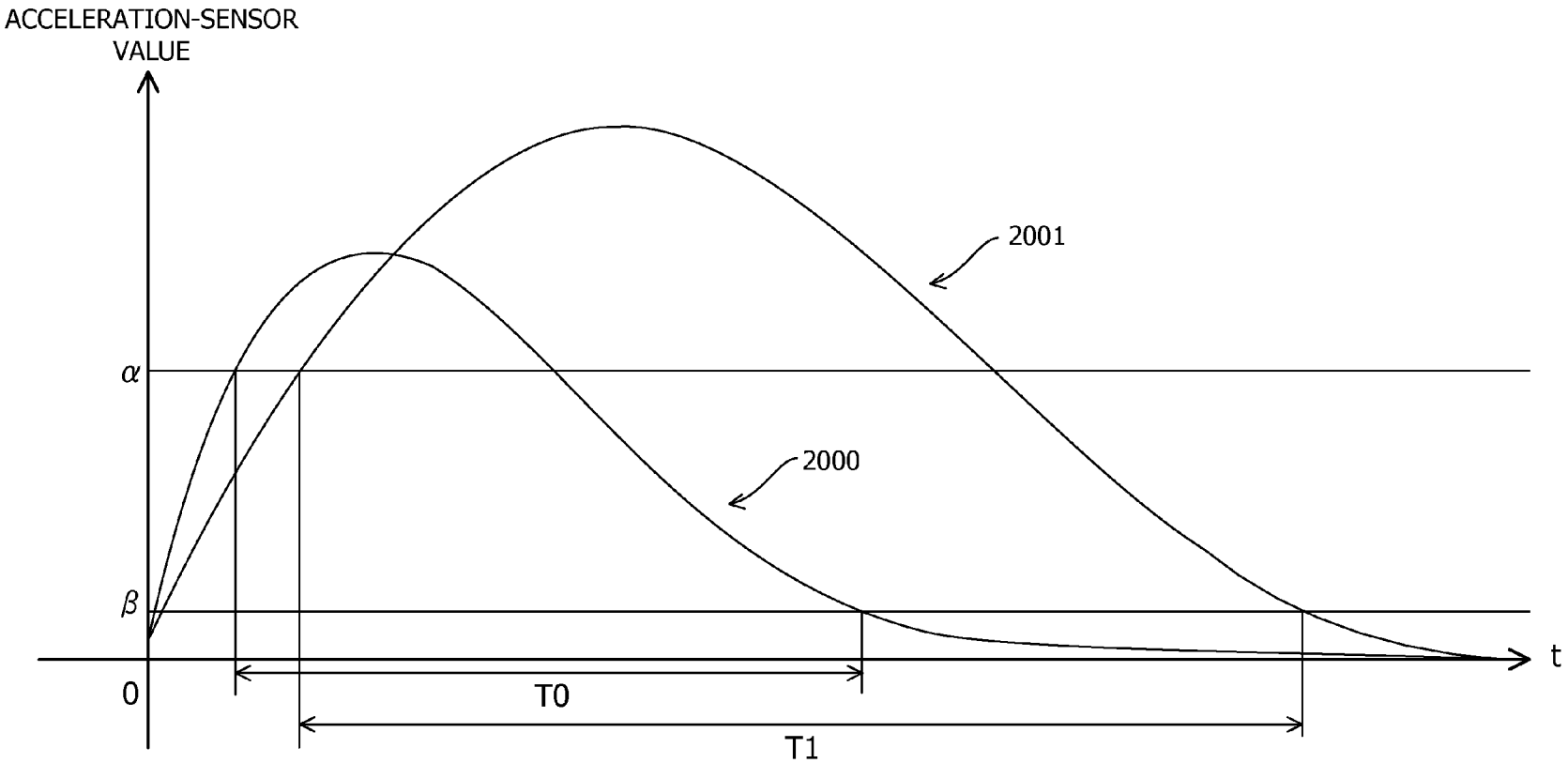

FIG. 20 is a graph of an example of an acceleration-sensor value detected by the acceleration sensor of the performance apparatus in the fourth embodiment.

DETAILED DESCRIPTION OF THE PREFERRED EMBODIMENTS

Figure 1:
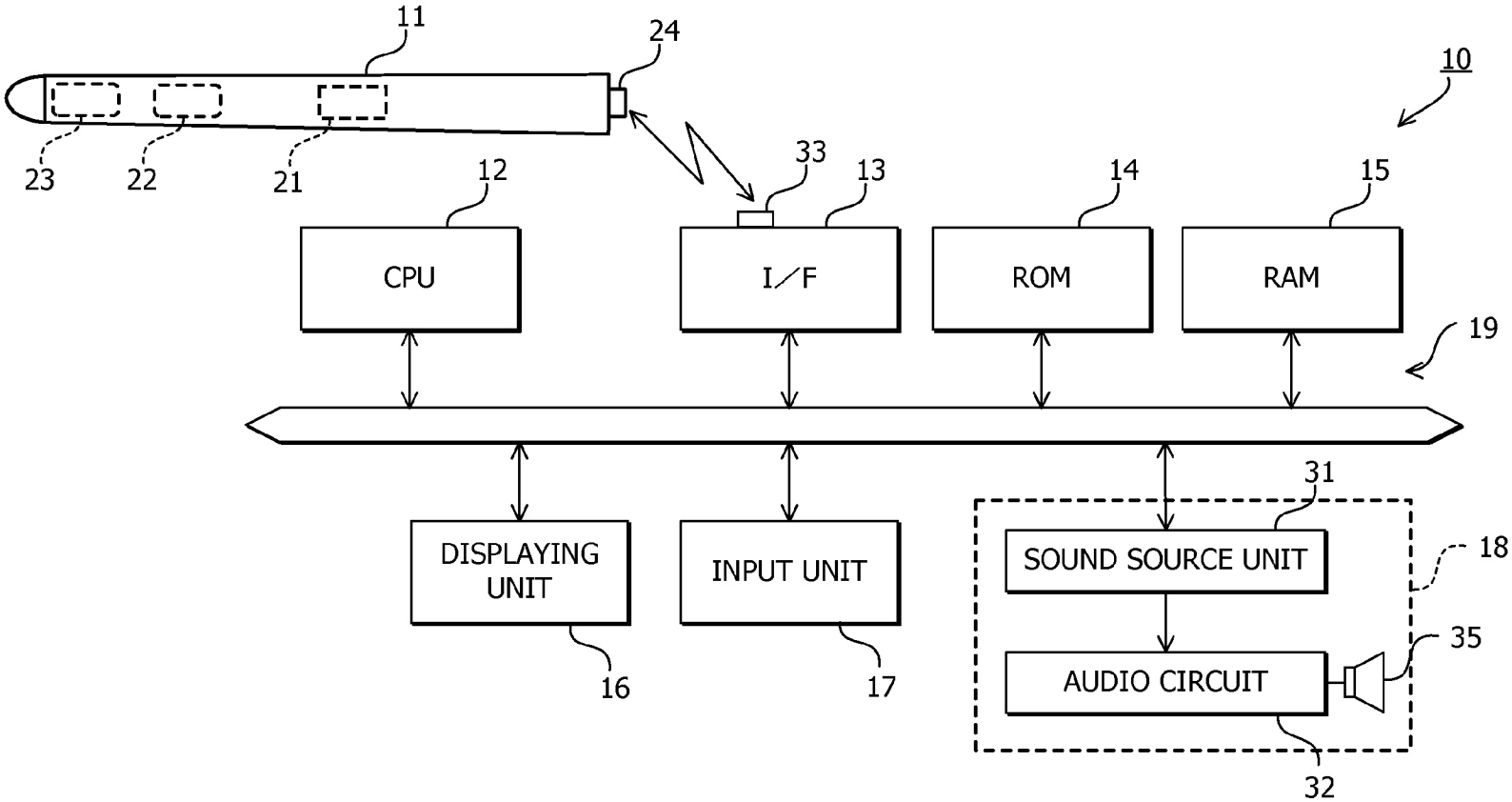
FIG. 1 is a block diagram showing a configuration of an electronic musical instrument according the first embodiment of the invention.

Now, embodiments of the present invention will be described with reference to the accompanying drawings. FIG. 1 is a block diagram showing a configuration of an electronic musical instrument according the first embodiment of the invention. As shown in FIG. 1, the electronic musical instrument 10 according the first embodiment is provided with a stick-type performance apparatus 11, which extends in a longitudinal direction. The performance apparatus 11 is held or gripped by a player with hand to swing it down. Further, the electronic musical instrument 10 is provided with a musical instrument unit 19, which generates musical tones. The musical instrument unit 19 comprises CPU 12, an interface (I/F) 13, ROM 14, RAM 15, a displaying unit 16, an input unit 17 and a sound system 18. As will be described later, the performance apparatus 11 is provided with an acceleration sensor 23 and a geomagnetic sensor 22 on the side opposite to the base of the elongated apparatus 11. The player grips the base to swing the elongated performance apparatus 11 down.

The I/F 13 of the musical instrument unit 19 serves to receive data (for instance, a note-on event) from the performance apparatus 11 to store the received data in RAM 15 and gives notice of receipt of such data to CPU 12. In the present embodiment, the performance apparatus 11 is provided with an infrared communication device 24 at the edge of the base of the performance apparatus 11 and the I/F 13 of the musical instrument unit 19 is also provided with an infrared communication device 33. Therefore, the infrared communication device 33 of I/F 13 receives infrared light generated by the infrared communication device 24 of the performance device 11, whereby the musical instrument unit 19 can receive data from the performance apparatus 11.

CPU 12 serves to control whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores various programs for controlling the whole operation the electronic musical instrument 10, controlling the operation of the musical instrument unit 19, detecting the operated state of the key switches (not shown) in the input unit 17 and generating musical tones based on note-on events received through I/F 13. ROM 14 has a waveform-data area for storing various timbres of waveform data. In particular, the waveform data includes waveform data of percussion instruments such as bass drums, high-hats, snare drums and cymbals. The waveform data is not limited to data of the percussion instruments but waveform data of wind instruments such as flutes, saxes and trumpets, waveform data of keyboard instruments such as pianos, and waveform data of string instruments such as guitars may be stored in ROM 14.

RAM 15 serves to store the program read from ROM 14, and data and parameters generated during the course of process. The data generated in the process includes the manipulated state of the switches in the input unit 17, sensor values received through I/F 13 and generating states of musical tones(sound generation graph).

The displaying unit 16 has a liquid crystal displaying device (not shown) and is able to display a selected timbre and a table, which associates ranges of differences in angle with pitches of musical tones, respectively. The input unit 17 has the switches (not shown), and is used to designate a timbre of musical tones to be generated.

The sound system 18 comprises a sound source unit 31, audio circuit 32 and a speaker 35. In accordance with an instruction from CPU 12, the sound source unit 31 reads waveform data from the waveform-data area of ROM 14 to generate musical-tone data. The audio circuit 32 converts the musical-tone data generated by the sound source unit 31 into an analog signal, and amplifies the analog signal to output the amplified signal from the speaker 35, whereby musical tones are output from the speaker 35.

Figure 2:
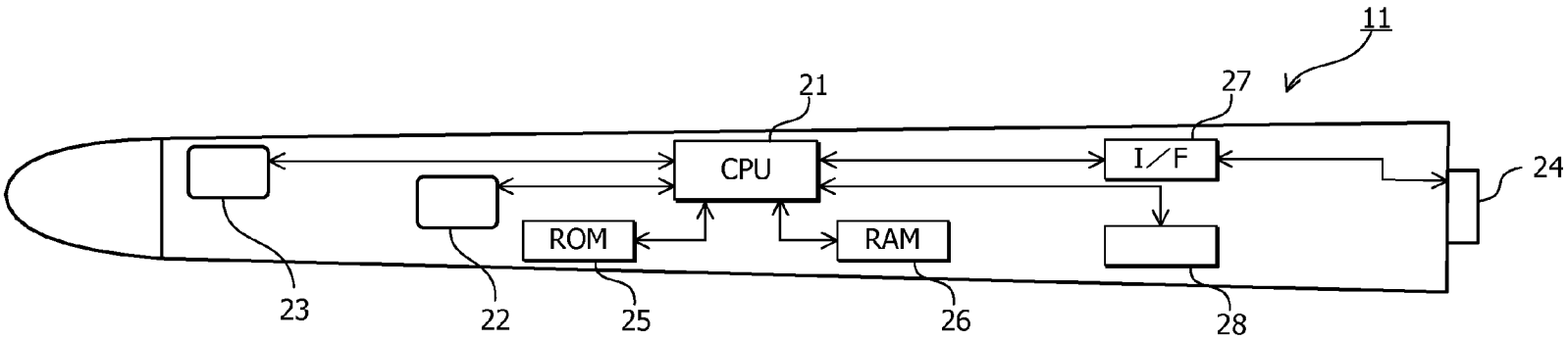
FIG. 2 is a block diagram showing a configuration of a performance apparatus according to the first embodiment of the invention.

FIG. 2 is a block diagram of a configuration of the performance apparatus 11 according to the first embodiment of the invention. As shown in FIG. 2, the performance apparatus 11 is provided with the geomagnetic sensor 22 and the acceleration sensor 23 on the side opposite to the base where the player holds. The position of the geomagnetic sensor 22 is not limited to the side opposite to the base, but the geomagnetic sensor 22 may be arranged close to the base. The geomagnetic sensor 22 has a magneto-resistive effect device and/or Hall element, and is able to detect magnetic-field components in x, y and z-direction, respectively. The acceleration sensor 23 is a sensor of a capacitance type and/or a piezoresistive type, and is able to output a data value indicating an acceleration. The acceleration sensor 23 in the present embodiment outputs an acceleration-sensor value in the axial direction of the performance apparatus 11.

When the player actually plays the drum, he or she holds the one end (base) of the stick with his or her hand and rotates the stick with his or her wrist kept at the center. In the present embodiment, the acceleration sensor 23 obtains an acceleration-sensor value in the axial direction of the performance apparatus 11 to detect centrifugal force caused by a rotational motion of the stick. In this case, three axial sensors can be used.

The performance apparatus 11 comprises CPU 21, the infrared communication device 24, ROM 25, RAM 26, an interface (I/F) 27 and an input unit 28. CPU 21 performs various processes including an obtaining operation of a sensor value in the performance apparatus 11, a detecting operation of a timing of sound generation of a musical tone in accordance with the sensor value and a reference value generated by the geomagnetic sensor 22, a producing operation of a note-on event, and an operation of controlling a sending operation of the note-on event through I/F 27 and the infrared communication device 24.

ROM 25 stores various programs for obtaining a sensor value from the performance apparatus 11, detecting a timing of sound-generation of a musical tone in accordance with the sensor value and a reference value generated by the geomagnetic sensor 22, producing a note-on event, and controlling the sending operation of the note-on event through I/F 27 and the infrared communication device 24. In RAM 26 are stored values obtained and/or produced in the processes, such as sensor values. Data is transmitted through I/F 27 to the infrared communication device 24 in accordance with an instruction from CPU 21. The input unit 28 includes switches (not shown).

Figure 3:
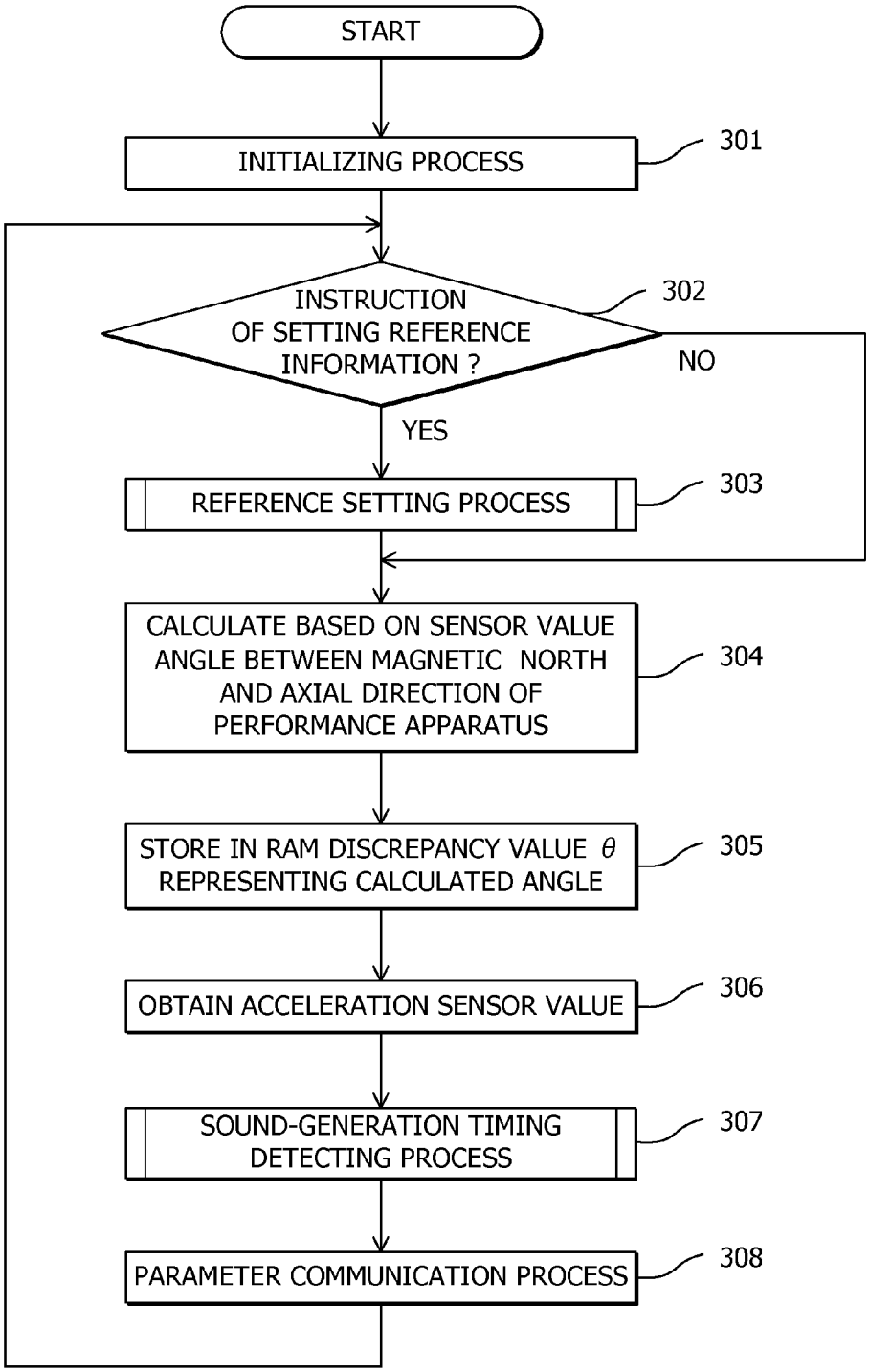
FIG. 3 is a flow chart of an example of a process performed in the performance apparatus according to the first embodiment.

FIG. 3 is a flow chart showing an example of a process performed in the performance apparatus 11 according to the present embodiment. CPU 21 of the performance apparatus 11 performs an initializing process at step 301, including a process of clearing data in RAM 26. Then, CPU 21 judges at step 302 whether or not the switch in the input unit 28 has been operated to give an instruction of setting reference information. When it is determined that the instruction of setting reference information has been given (YES at step 302), CPU 21 performs a reference setting process at step 303.

Figure 4:
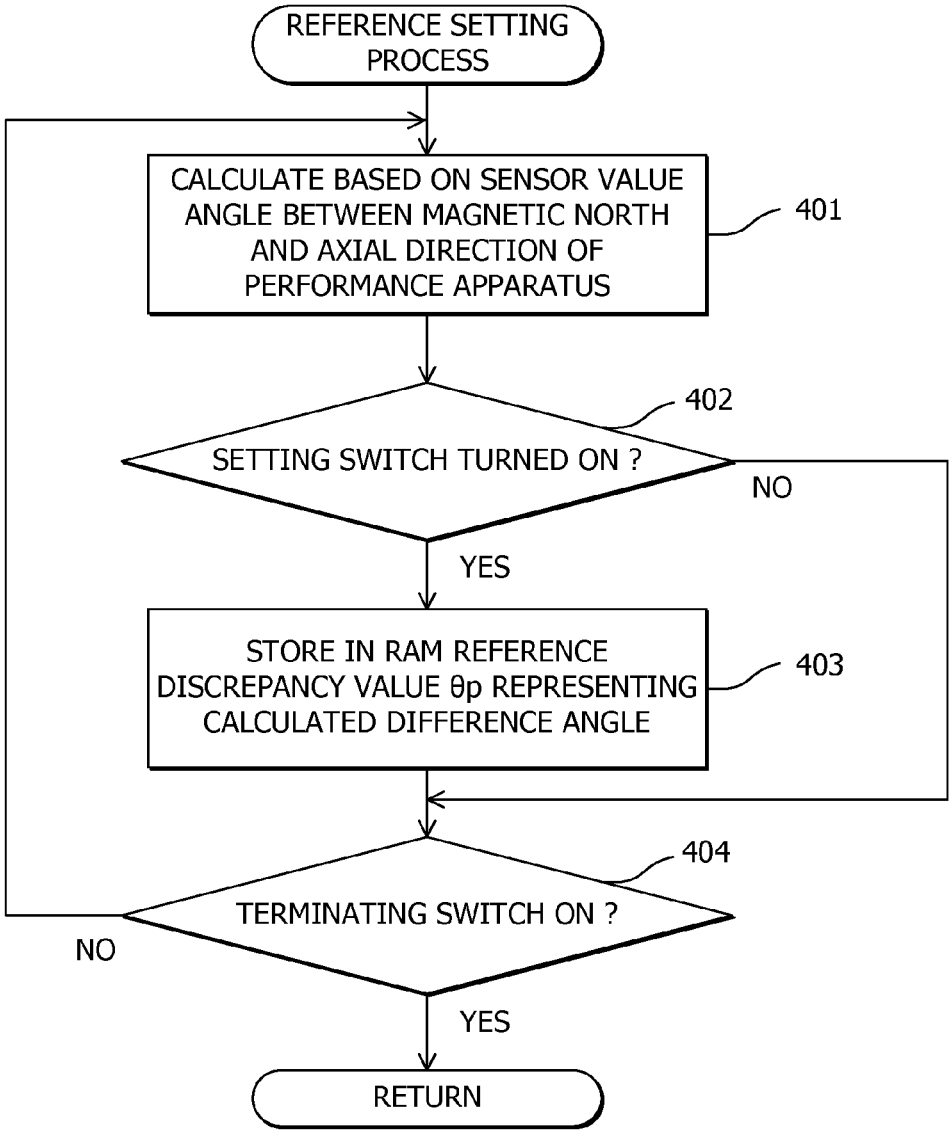
FIG. 4 is a flow chart of an example of a reference setting process performed in the performance apparatus according to the first embodiment.

FIG. 4 is a flow chart showing an example of the reference setting process performed in the performance apparatus 11 according to the present embodiment. In the reference setting process, the direction, in which the performance apparatus 11 is held by the player at the time when he or she turns on a setting switch (not shown) in the input unit 28 is obtained as the reference value (reference offset value or reference discrepancy value). CPU 21 obtains a sensor value indicated by the geomagnetic sensor 22, and calculates an angle (difference angle) between the axial direction of the performance apparatus 11 and the magnetic north based on the obtained sensor value at step 401. The angle (difference angle) indicates a difference in angle between the magnetic north and the axial direction of the performance apparatus 11.

CPU 21 judges at step 402 whether or not the setting switch of the input unit 28 has been turned on. When it is determined at step 402 that the setting switch has been turned on (YES at step 402), CPU 21 stores the calculated difference angle in RAM 26 as a reference discrepancy value θp at step 403. Then, CPU 21 judges at step 404 whether or not a terminating switch (not shown) in the input unit 28 has been turned on. When it is determined at step 404 that the terminating switch has not been turned on (NO at step 404) , CPU 21 returns to the process at step 401. Meanwhile, when it is determined at step 404 that the terminating switch has been turned on (YES at step 404), the reference setting process will terminate. During the course of the reference setting process described above, the reference offset values or reference discrepancy values θp are stored in RAM 26.

When the reference setting process terminates at step 303 in FIG. 3, CPU 21 obtains the sensor value of the geomagnetic sensor 22, and calculates at step 304 a current angle (difference angle) between the axial direction of the performance apparatus 11 and the magnetic north based on the obtained sensor value. CPU 21 stores the calculated difference angle in RAM 26 as an offset value or discrepancy value θ at step 305. CPU 21 obtains a sensor value (acceleration-sensor value) from the acceleration sensor 23 and stores the obtained sensor value in RAM 26 at step 306. As described above, the sensor value in the axial direction of the performance apparatus is employed as an acceleration value in the present embodiment.

Figure 5:
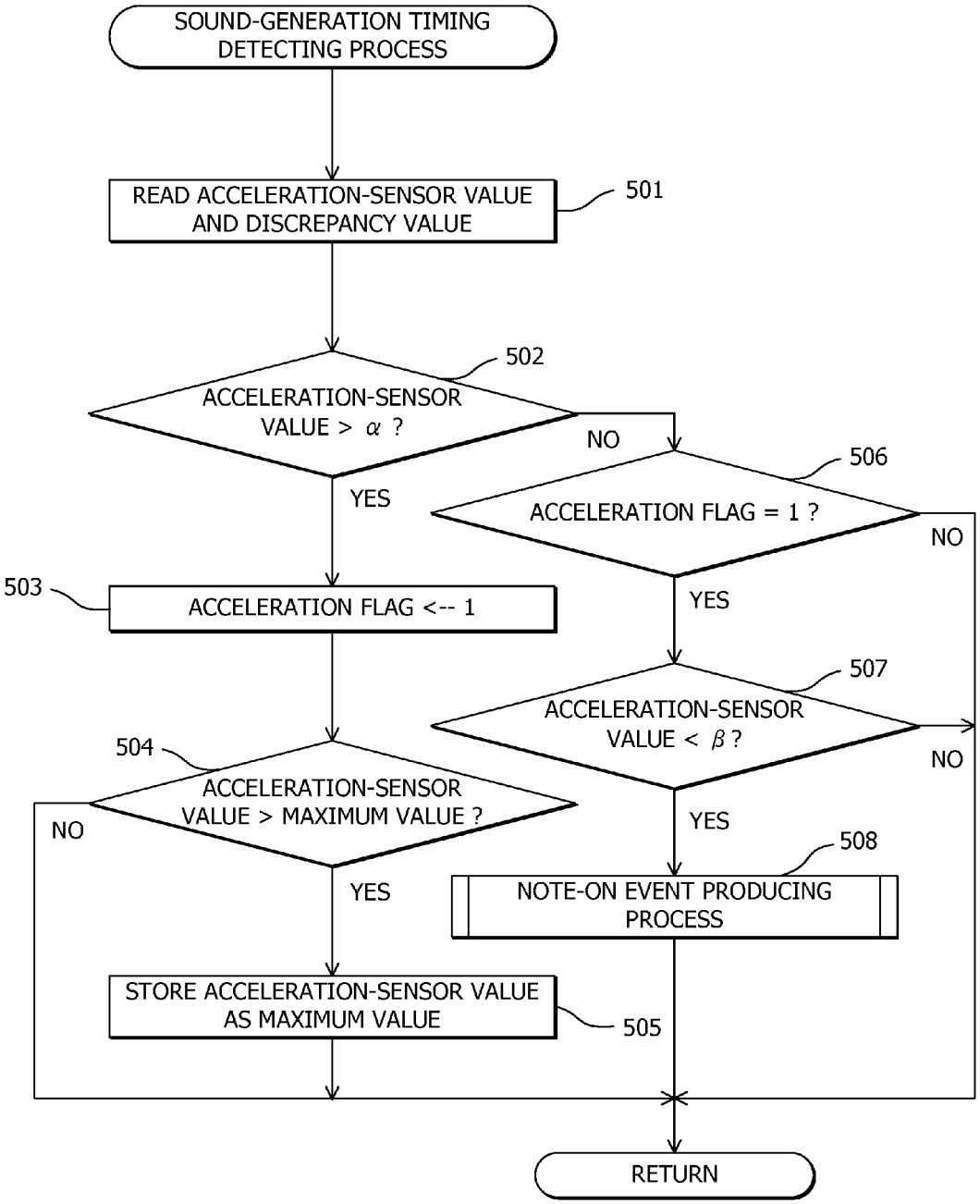
FIG. 5 is a flow chart of an example of a sound-generation timing detecting process performed in the performance apparatus according to the first embodiment.

Then, CPU 21 performs a sound-generation timing detecting process at step 307. FIG. 5 is a flow chart showing an example of the sound-generation timing detecting process performed in the performance apparatus 11 according to the present embodiment. CPU 21 reads an acceleration-sensor value and a discrepancy value θ from RAM 26 at step 501. Then, CPU 21 judges at step 502 whether or not the acceleration-sensor value is larger than a predetermined first threshold value α. When it is determined at step 502 that the acceleration-sensor value is larger than the first threshold value α (YES at step 502), CPU 21 sets a value of "1" to an acceleration flag in RAM 26 at step 503. Further, CPU 21 judges at step 504 whether or not the acceleration-sensor value read at step 501 is larger than the maximum acceleration-sensor value stored in RAM 26. When it is determined YES at step 504, CPU 21 stores in RAM 26 the acceleration-sensor value read at step 501 as a new maximum value at step 505.

When it is determined at step 502 that the acceleration-sensor value is not larger than the first threshold value α (NO at step 502), CPU 21 judges at step 506 whether or not a value of "1" has been set to the acceleration flag in RAM 26. When it is determined at step 506 that a value of "1" has not been set to the acceleration flag (NO at step 506), the sound-generation timing detecting process will terminate. When it is determined at step 506 that a value of "1" has been set to the acceleration flag (YES at step 506), CPU 21 judges at step 507 whether or not the acceleration-sensor value is less than a predetermined second threshold value β. When it is determined YES at step 507, CPU 21 performs a note-on event producing process at step 508.

Figure 6:
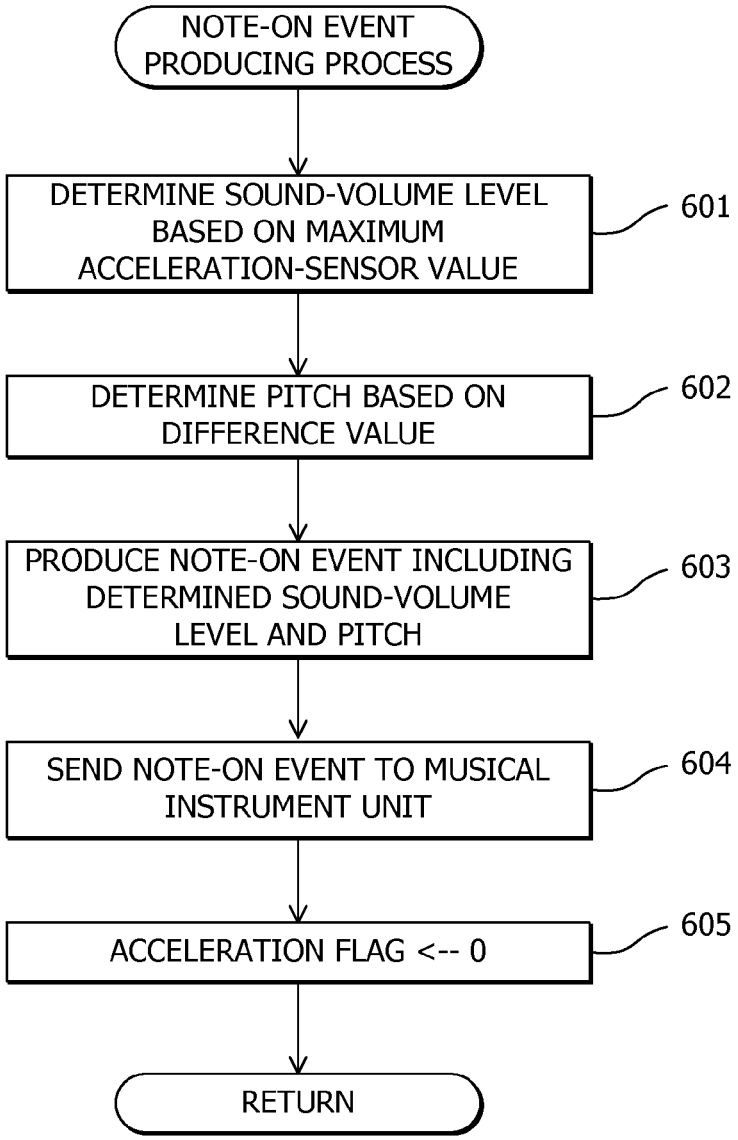
FIG. 6 is a flow chart of an example of a note-on event producing process performed in the performance apparatus according to the first embodiment.

FIG. 6 is a flow chart showing an example of the note-on event producing process performed in the performance apparatus 11 according to the present embodiment. In the note-on event producing process shown in FIG. 6, a note-on event is sent from the performance apparatus 11 to the musical instrument unit 19, and then a sound generating process (FIG. 7) is performed in the musical instrument unit 19, whereby musical tone data is generated and musical tones are output from the speaker 35.

Figure 8:
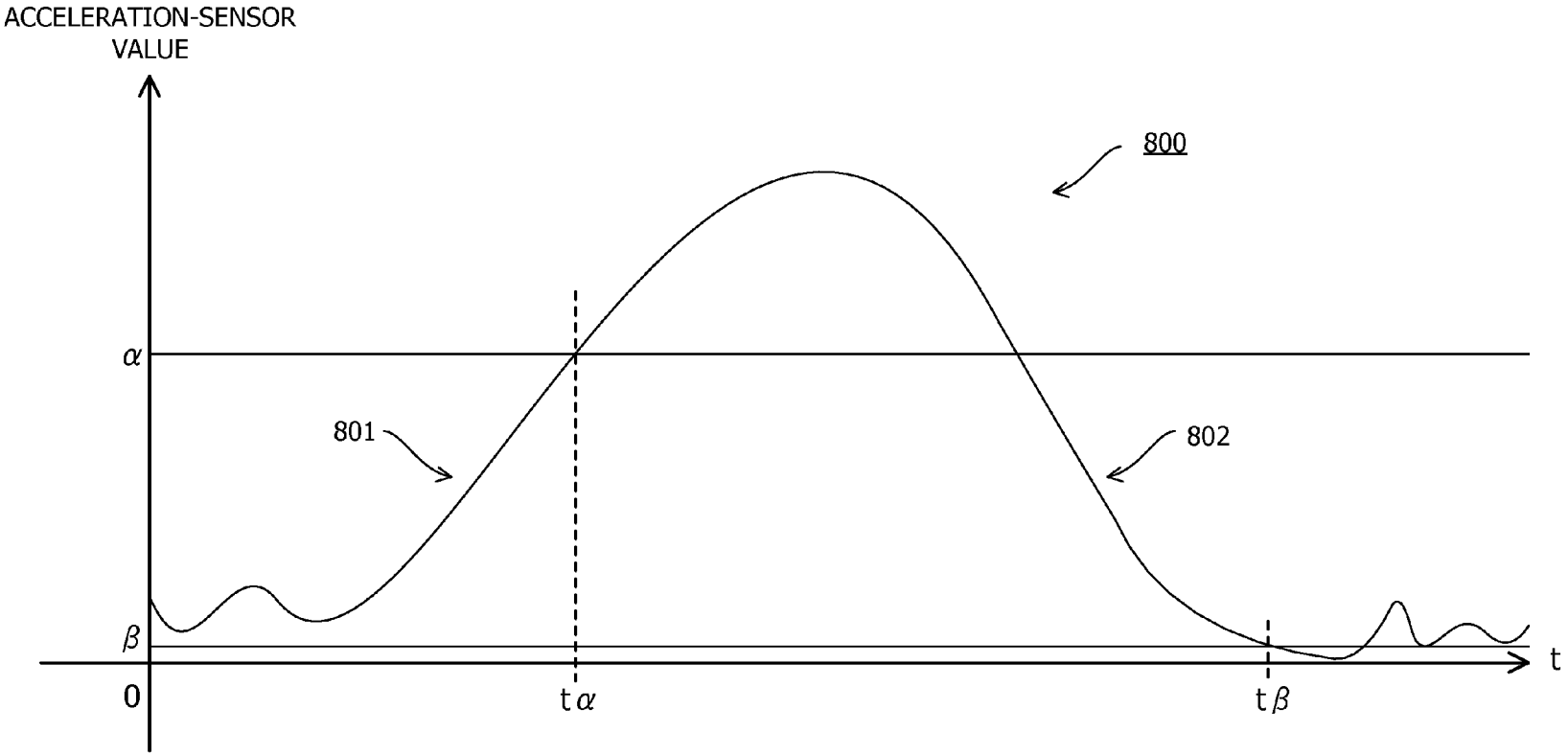
FIG. 8 is a graph that typically represents an acceleration-sensor value detected by an acceleration sensor of the performance apparatus.

Before describing the note-on event producing process, the sound-generation timing in the electronic musical instrument 10 of the present embodiment will be described. FIG. 8 is a graph that typically represents acceleration-sensor values detected by the acceleration sensor 23 of the performance apparatus 11. When the player grips one end (the base) of the performance apparatus 11 and swings the performance apparatus 11 down, the performance apparatus 11 makes rotating motion about a fulcrum at the player's wrist, elbow or shoulder. This rotating motion of the performance apparatus 11 causes centrifugal force, yielding acceleration in the performance apparatus 11 in its axial direction.

When the player swings the performance apparatus 11 down, the acceleration value gradually increases (refer to Reference number 801, a curve 800 in FIG. 8). When the player swings the elongated performance apparatus 11 of a stick type, in general, he or she moves his or her body as if he or she actually dubs or beats drums and other percussion instruments. Therefore, the player stops his or her motion just before he or she strikes the imaginary surface or head of the drum. Accordingly, the acceleration value begins to gradually decrease after such time (refer to Reference number 802). The player supposes that musical tones will be generated at the time when the imaginary surface of the drum has been struck. Therefore, it is preferable to generate musical tones at the time when the player expects the sound is generated.

So as to make the electronic musical instrument generate musical tones at the time or just before the player strikes the imaginary surface of the drum, the present invention employs the following logic. It is assumed in the present embodiment that the sound-generation timing is defined by a time when the acceleration sensor value decreases to a value less than the second threshold value β, which is slightly larger than "0". But the sound-generation timing can reach around the second threshold value β, because of fluctuation of the acceleration sensor value due to unintentional motion of the player. Therefore, to avoid effects of the fluctuation of the acceleration-sensor value, a condition is set that requires the acceleration sensor value to once increase to a value larger than the first threshold value α (the value of α is sufficiently larger than the value β). In other words, the sound generating timing is specified by a time tβ when the acceleration-sensor value increases to a value larger than the first threshold value α (refer to a time tα in FIG. 8) and then has decreased to a value less than the second threshold value β (refer to a time tβ). When it is determined that the sound generating timing has reached as described above, a note-on event is produced in the performance apparatus 11 and sent to the musical instrument unit 19. In response to the production of a note-on event, the sound generating process is performed in the musical instrument unit 19 to produce a musical tone.

In the note-on event producing process shown in FIG. 6, CPU 21 refers to the maximum value among the acceleration-sensor values stored in RAM 26 to determine a sound-volume level (velocity) of a musical tone at step 601.

The maximum value of the acceleration-sensor value is denoted by Amax, and the maximum value of the sound-volume level (velocity) is denoted by Vmax. Then, the sound-volume level Vel will be given by the following equation:

$$\mathrm{Vel}=a\cdot A\mathrm{max},\ \text{where if } a\cdot A\mathrm{max}\geq V\mathrm{max},\ \mathrm{Vel}=V\mathrm{max},\ \text{and "}a\text{" is a positive constant.}$$

Then, CPU 21 calculates a difference value (θd=θ−θp) between the discrepancy value θ and the reference discrepancy value θp, both stored in RAM 26. CPU 21 determines a pitch of a musical tone to be generated based on the calculated difference value (θd=θ−θp) at step 602. FIG. 9*a* and FIG. 9*b* are views for explaining the difference value θd.

The difference value θd between the direction (reference direction) (Reference symbol: P), in which the performance apparatus 11 is held at the time when the setting switch is turned on and a direction (Reference symbol: C) of the performance apparatus 11 which has been swung down can be positive as shown in FIG. 9*a* and also can be negative as shown in FIG. 9*b*. If the performance apparatus 11 is swung down on the left side of the reference position seen from the player, the difference value θd will be positive. If the performance apparatus 11 is swung down on the right side of the reference position seen from the player, the difference value θd will be negative.

Toms (Hi-tom, Low tom and Floor tom) of a drum set are arranged in order of pitch around a single player in a clockwise direction. For example, the toms are arranged in a clockwise direction in order of a hi-tom, low tom and floor tom. Therefore, in the case that musical tones of timbres of percussion instruments are generated, the pitches of the performance apparatus 11 are set so as to go low as the axial direction of the performance apparatus 11 moves in a clockwise direction while the player swings the performance apparatus 11 down repeatedly as if he or she strikes drums and other percussion instruments. Meanwhile, in the keyboard instruments such as pianos, marimbas and vibraphones, a key, which is arranged to the rightward in the keyboard seen from the player generates a tone of a higher pitch. Therefore, in the case that musical tones of timbres of keyboard instruments are generated, the pitches of the performance apparatus 11 are set so as to go high as the axial direction of the performance apparatus 11 moves in a clockwise direction while the player swings the performance apparatus 11 down repeatedly.

FIG. 10*a* is a view showing an example of a table, which associates pitches of musical tones of the percussion instruments with ranges of the difference values θd, respectively. FIG. 10*b* is a view schematically showing relationship between pitches of musical tones and ranges, in which the performance apparatus 11 is swung by the player as if he or she beats drums and other percussion instruments. The table shown in FIG. 10*a* is stored in RAM 26. The pitches P1 to P4 given in the table of FIG. 10*a* has the relationship of P1<P2<P3<P4.

At step 602 in FIG. 6, CPU 21 refers to the table 1000 stored in RAM 26 to read pitch information corresponding to the difference value θd. Thereafter, CPU 21 produces a note-on event including information representing a sound volume level (velocity), a pitch and a timbre at step 603.

CPU 21 outputs the produced note-on event to the infrared communication device 24 through I/F 27 at step 604. Then, an infrared signal of the note-on event is sent from the infrared communication device 24. The infrared signal sent from the infrared communication device 24 is received by the infrared communication device 33 of the musical instrument unit 19. Thereafter, CPU 21 resets the acceleration flag in RAM 26 to "0" at step 605.

When the sound-generation timing detecting process finishes at step 307 in FIG. 3, CPU 21 performs a parameter communication process at step 308. The parameter communication process (step 308) will be described together with a parameter communication process in the musical instrument unit 19 (step 705 in FIG. 7).

The process to be performed in the musical instrument unit 19 according to the present embodiment will be described.

Figure 7:
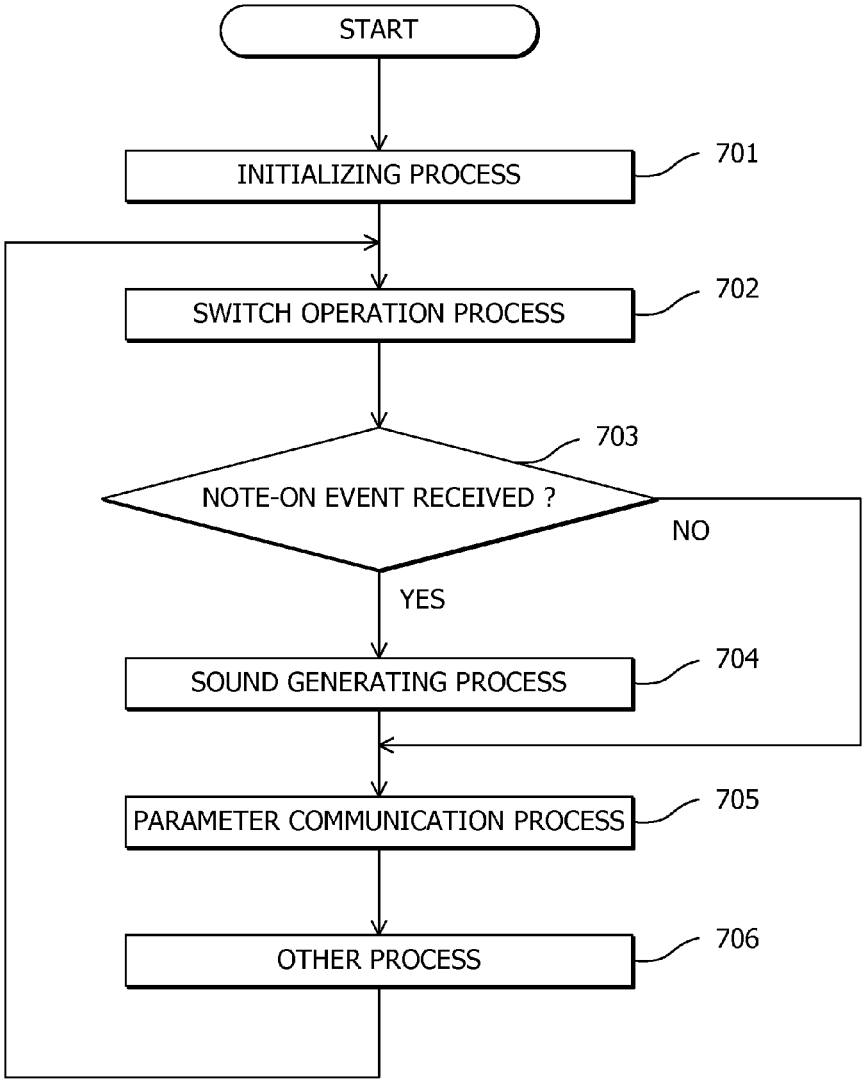
FIG. 7 is a flow chart of an example of a process performed in the musical instrument unit according to the first embodiment.

FIG. 7 is a flow chart of an example of the process performed in the musical instrument unit 19 according to the present embodiment. CPU 12 of the musical instrument unit 19 performs an initializing process at step 701, thereby clearing data in RAM 15 and an image on the display screen of the displaying unit 16 and clearing the sound source 31. Then, CPU 12 performs a switch operation process at step 702. The switch operation process will be described.

CPU 12 sets a timbre of a musical tone to be generated in accordance with switching operation of the input unit 17. CPU 12 stores designated timbre information in RAM 15. CPU 12 designates the table in RAM 15 based on the selected timbre, wherein the ranges of the difference values θd and pitches are associated with each other in the table. In the present embodiment, plural tables corresponding to timbres of musical tones to be generated are prepared, and a table is selected based on the selected timbre of the musical tone.

A rearrangement may be possible such that a table is edited, which associates the ranges of the difference values θd with pitches of musical tones, respectively. For example, CPU 21 displays the contents of the table on the display screen of the displaying unit 16, allowing the player to change the range of difference values θd and pitches of musical tones by operating the switches and ten keys in the input unit 17. The table whose contents are changes is stored in RAM 15.

CPU 12 judges at step 703 whether or not any note-on event has been received through I/F 13. When it is determined at step 703 that a note-on event has been received (YES at 703), CPU 12 performs the sound generating process at step 704. In the sound generating process, CPU 12 outputs the received note-on event to the sound source unit 31. The sound source unit 31 reads waveform data from ROM 14 in accordance with the timbre represented in the note-on event. The waveform data is read at a rate corresponding to the pitch included in the note-on event. The sound source unit 31 multiplies the waveform data by a coefficient corresponding to the sound-volume data (velocity) included in the note-on event, producing musical tone data of a predetermined sound-volume level. The produced musical tone data is supplied to the audio circuit 32, and musical tones are finally output through the speaker 35.

After the sound generating process (step 704), CPU 12 performs a parameter communication process at step 705. In the parameter communication process, CPU 12 gives an instruction to the infrared communication device 33, and the infrared communication device 33 sends the timbre of musical tones which are set to be generated in the switch operation process and data of the table to the performance apparatus 11 through I/F 13, wherein the table associates pitches of musical tones with the range of the difference values θd corresponding to said timbres of musical tones (step 702). In the performance apparatus 11, when the infrared communication device 24 receives the data, CPU 21 stores the data in RAM 26 through I/F 27 at step 308 in FIG. 3.

When the parameter communication process finishes at step 705 in FIG. 7, CPU 12 performs other process at step 706. For instance, CPU 12 updates the image on the display screen of the displaying unit 16.

The elongated performance apparatus 11 according to the present embodiment is provided with the acceleration sensor 23 on the extending portion where the player holds or grips with his or her hand. CPU 21 of the performance apparatus 11 gives an instruction (note-on event) of generating sounds to the sound source unit 31 for generating musical tones. CPU 21 produces a note-on event at the time when the acceleration-sensor value of the acceleration sensor 23 once increases to a value larger than the first threshold value α and thereafter has reached a value less than the second threshold value β, wherein the second threshold value β is less than the first threshold value α, giving an instruction of generating sounds to the musical instrument unit 19. Therefore, the musical instrument unit 19 can generate sounds at the moment when the player strikes the imaginary surface or head of the drum with his or her drumstick.

In the present embodiment, the performance apparatus 11 is provided with the geomagnetic sensor 22. CPU 21 obtains a difference value θd representing angles between the axial direction of the performance apparatus 11 and the predetermined orientation based on the sensor value of the geomagnetic sensor 22. Further, CPU 21 determines a pitch of a musical tone to be generated based on the obtained difference value θd. Therefore, the player can change the pitch of the musical tones by selecting an orientation of the direction, in which he or she swings the performance apparatus 11 down.

In the present embodiment, CPU 21 determines a pitch of a musical tone such that the pitch constantly increases or decreases as the difference value θd increases. In general, the keyboard instruments and toms of a drum set are arranged to constantly change the pitches as the player plays the instrument along some direction. Therefore, the player can intuitively generate musical tones of his or her desired pitch.

In the present embodiment, CPU 21 obtains the offset value or discrepancy value θ representing angles between the magnetic north and the axial direction of the performance apparatus 11. Further, CPU 21 obtains the reference offset value or reference discrepancy values θp representing the reference orientation, wherein the reference discrepancy values θp represents angles between the magnetic north and the axial direction of the performance apparatus 11 held for setting. And CPU 21 calculates a difference value representing a difference between the discrepancy value θ and the reference discrepancy values θp, whereby the player can generate a musical tone of his or her desired pitch and in his or her desired position.

In the present embodiment, CPU 21 detects the maximum value of the acceleration-sensor values of the acceleration sensor 22 and calculate a sound-volume level in accordance with the detected maximum value. Then, CPU 21 produces a note-on event representing the calculated sound volume level. Therefore, the player can use the performance apparatus 11 to generate a musical tone having a sound volume corresponding to a rate at which he or she swings the performance apparatus 11 down.

For example, in the present embodiment, CPU 21 calculates the sound volume level Vel from the following equation:

$$\mathrm{Vel}=a\cdot A\max,\ \text{where if } a\cdot A\max \geq V\max,\ \mathrm{Vel}=V\max,\ \text{and "}a\text{" is a positive constant.}$$

Using the calculated sound volume level, a musical tone can be generated, having a precise sound volume corresponding to a rate at which the performance apparatus 11 is swung down.

Now, the second embodiment of the present invention will be described. In the first embodiment, the pitch of a musical tone to be generated is adjusted based on the difference value, θd=(θ−θp), representing angles between the reference discrepancy value θp and the axial direction of the elongated performance apparatus 11. But in the second embodiment, a timbre of a musical tone to be generated is adjusted based on the difference value, θd=(θ−θp). In the second embodiment, processes to be performed in the performance apparatus 11 are substantially the same as those in the first embodiment except the note-on event producing process.

FIG. 11 is a flow chart showing an example of the note-on event producing process performed in the second embodiment. A process at step 1101 in FIG. 11 is performed substantially in the same manner as at step 601 FIG. 6. Then, CPU 21 calculates a difference value θd=(θ−θp) between the discrepancy value θ stored in RAM 26 and the reference discrepancy value θp stored in RAM 26, and determines the timbre of the musical tone to be generated based on the calculated difference value θd at step 1102. The ranges of the difference values θd and the corresponding timbres are stored in the table. FIG. 12*a* is a view showing an example of a table, which associates timbres of musical tones of the percussion instruments with ranges of the difference values θd, respectively. FIG. 12*b* is a view schematically showing relationship between timbres of musical tones and ranges, in which the performance apparatus 11 is swung down by the player, as if he or she strikes drums and other percussion instruments.

As shown in FIG. 10*a* and FIG. 10*b*, the performance apparatus 11 is arranged such that musical tones of timbres of the floor toms, low toms and hi-toms will be generated when the player swings the performance apparatus 11 down respectively in imaginary ranges arranged in a counter clockwise direction. The arrangement of the performance apparatus 11 substantially corresponds to the actual arrangement of the percussion instruments of the drum set.

Thereafter, CPU 21 produces a note-on event including a sound-volume level (velocity), pitch and timbre of a musical tone to be generated (step 1103), wherein pitch information can be constant at step 1103. Processes to be performed at step 1104 and the processes to be performed at step 1105 are substantially the same as those at steps 604 and 605 in FIG. 6.

In the switch operation process (step 702 in FIG. 7) performed by the musical instrument unit 19 according to the second embodiment, the contents of the table can be edited, wherein the table associates timbres of musical tones with the ranges of difference values θd, respectively. The table whose contents are edited is stored in RAM 15, and thereafter, is transferred from the musical instrument unit 19 to the performance apparatus 11 in the parameter communication process (at step 705 in FIG.7, and at step 308 in FIG. 3) . Then, the table is stored in RAM 26 of the performance apparatus 11.

In the second embodiment, CPU 21 obtains the difference value representing a difference in angle between the predetermined reference orientation and the orientation of the axial direction of the elongated performance apparatus 11. CPU 21 determines the timbre of a musical tone to be generated based on the obtained difference value. Therefore, the timbre of the musical tone to be generated can be changed depending on the orientation of the axial direction of the performance apparatus 11, which the player swings down.

Now, the third embodiment of the present invention will be described. In the third embodiment, the sound volume level (velocity) of a musical tone to be generated is determined depending on which one of the ranges of the acceleration sensor values the maximum acceleration sensor value belongs to. In the first embodiment, the sound volume level (velocity) is determined at step 601 from the following equation:

$$\mathrm{Vel}=a\cdot A\mathrm{max}\ (\leq V\mathrm{max})$$

In the third embodiment, the sound volume level is determined at step 601 as described below.

In RAM 26 is stored the table which associates the sound volume levels (velocity) with the ranges of the maximum values Amax of the acceleration sensor values, respectively. FIG. 13 is a graph for explaining relationship between the sound volume levels (velocity) and the corresponding ranges of the maximum values Amax of the acceleration-sensor values. In the third embodiment, a musical tone is not generated, unless the acceleration-sensor value exceeds at least the threshold value α. Therefore, as shown in FIG. 13, the following sound-volume levels Vel are associated with the ranges defined by the threshold value α and boundary values, A1 to A3 (α<A1<A2 <A3).

α<Amax≤A1:Vel=V1

A1<Amax≤A2:Vel=V2

A2<Amax≤A3:Vel=V3

A3<Amax:Vel=Vmax, where V1<V2<V3<Vmax.

For example, in the case where when the performance apparatus 11 is swung down and an acceleration-sensor value is given by a curve 1301 (FIG. 13), CPU 21 refers to the table stored in RAM 26 to obtain a sound-volume level V1. In the case an acceleration-sensor value is given by a curve 1302, CPU 21 refers to the table stored in RAM 26 to obtain a sound-volume level V3.

In the third embodiment, CPU 21 obtains the sound-volume level depending on which range in the table the maximum value Amax belongs to. Therefore, an appropriate sound volume level can be determined without operating multiplication.

The present invention has been described with reference to the accompanying drawings and the first to the third embodiment, but it will be understood that the invention is not limited to these particular embodiments described herein, and numerous rearrangements, modifications, and substitutions may be made to the embodiments of the invention described herein without departing from the scope of the invention.

In the first to the third embodiment, CPU 21 of the performance apparatus 11 detects an acceleration-sensor value caused when the player swings the performance apparatus 11 down, determining the timing of sound generation. CPU 21 of the performance apparatus 11 calculates a discrepancy value based on a sensor value of the geomagnetic sensor 22, and determines a pitch (the first embodiment) and a timbre (the second embodiment) of a musical tone to be generated based on the calculated discrepancy value. Thereafter, CPU 21 of the performance apparatus 11 produces the note-on event including the pitch and timbre at the timing of sound generation, and transmits the note-on event to the musical instrument unit 19 through I/F 27 and the infrared communication device 24. Meanwhile, in the musical instrument unit 19, receiving the note-on event, CPU 12 supplies the received note-on event to the sound source unit 31, thereby generating a musical tone. The above arrangement is preferably used in the case that the musical instrument unit 19 is not a device specified for generating musical tones, such as personal computers and game machines provided with a MIDI board.

The processes to be performed in the performance apparatus 11 and the processes to be performed in the musical instrument unit 19 are not limited to those described herein in the embodiments.

For example, an rearrangement may be made to the performance apparatus 11, that obtains the reference discrepancy value, discrepancy values and acceleration sensor values, and sends them to the musical instrument unit 19. In the rearrangement, the sound generation timing detecting process (FIG. 5) and the note-on event producing process (FIG. 6) are performed in the musical instrument unit 19. The rearrangement is suitable for use in electronic musical instruments, in which the musical instrument unit 19 is used as a device specified for generating musical tones.

Now, the fourth embodiment of the present invention will be described. In the fourth embodiment, an acceleration sensor value caused when the performance apparatus 11 is swung down by the player is detected, and a sound generation timing is determined based on the detected acceleration sensor value. A sound volume level of a musical tone to be generated is determined based on information of a time interval "T" from the time when the acceleration sensor value reaches the first threshold value α to the time when immediately after the acceleration-sensor value reaches the second threshold value β.

FIG. 14 is a block diagram of a configuration of an electronic musical instrument according to the forth embodiment of the invention. As shown in FIG. 14, the electronic musical instrument 10 according to the forth embodiment has an elongated performance apparatus 110 of a stick type, which is gripped and swung down by the player. As will be described, the performance apparatus 110 is provided with an acceleration sensor 23 around at its end portion opposite to a base portion, where is to be held by the player with his or her hand.

FIG. 15 is a block diagram of the performance apparatus 110 in the fourth embodiment. The performance apparatus 110 has an acceleration sensor 23 around at its end portion opposite to the base portion, where is to be held by the player with his or her hand. The acceleration sensor 23 is a sensor of a capacitance type and/or a piezoresistive type, and is able to output a data value indicating an acceleration. The acceleration sensor 23 in the present embodiment outputs an acceleration value in the axial direction (Reference number 200 in FIG. 15) of the performance apparatus 110.

Like the performance apparatus 10 in the first to the third embodiment, the performance apparatus 110 comprises CPU 21, infrared communication device 24, ROM 25, RAM 26, interface (I/F) 27 and input unit 28. CPU 21 performs various processes including an obtaining operation of a sensor value of the performance apparatus 110, a detecting operation of a timing of sound generation of a musical tone in accordance with the sensor value and a reference value generated by the geomagnetic sensor 22, a producing operation of a note-on event, and an operation of controlling a sending operation of the note-on event through I/F 27 and the infrared communication device 24.

ROM 25 stores various programs for obtaining a sensor value of the performance apparatus 110, detecting a timing of sound generation of a musical tone in accordance with the sensor value and a reference value generated by the geomagnetic sensor 22, producing a note-on event, and controlling the sending operation of the note-on event through I/F 27 and the infrared communication device 24. Data is transmitted through I/F 27 to the infrared communication device 24 in accordance with an instruction from CPU 21. The input unit 28 includes switches (not shown).

FIG. 16*a* is a flow chart of an example of a process performed in the performance apparatus 110 according to the fourth embodiment. CPU 21 of the performance apparatus 110 performs an initializing process at step 1601, clearing data in RAM 26 and resetting a timer value "t". CPU 21 obtains and stores a sensor value (acceleration-sensor value) of the acceleration sensor 23 in RAM 26 at step 1602. As described above, the sensor value in the axial direction of the performance apparatus 110 is used as the acceleration-sensor value in the fourth embodiment.

CPU 21 performs a sound-generation timing detecting process at step 1603. FIG. 17 is a flow chart of an example of the sound-generation timing detecting process performed in the fourth embodiment. CPU 21 reads an acceleration-sensor value from RAM 26 at step 1701. Then, CPU 21 judges at step 1702 whether or not the acceleration-sensor value is larger than the first threshold value α. When it is determined YES at step 1702, CPU 21 makes a timer interruption effective at step 1703, setting a value of "1" to the acceleration flag in RAM 26 at step 1704. FIG. 16*b* is a flow chart of an example of the timer interruption process. The timer interruption process is performed at step 1611 to increment the timer value "t" every certain time interval, every time the timer interruption is made effective.

After the process of step 1704, CPU 21 adds a timer value "t" to the time-interval information "T" at step 1705, thereby updating said time-interval information "T". Then, the time-interval information "T" is stored in RAM 26. Thereafter, CPU 21 resets the timer value "t" to a value of "0" at step 1706.

When it is determined at step 1702 that the acceleration sensor value is not larger than the first threshold value α (NO at step 1702), CPU 21 judges at step 1707 whether or not the acceleration flag in RAM 26 has been set to "1". When it is determined YES at step 1707, CPU 21 judges at step 1708 whether or not the acceleration sensor value is less than the second threshold value β. When it is determined NO at step 1708, CPU 21 advances to step 1705 to add the timer value "t" to the time-interval information "T". When it is determined YES at step 1708, CPU 21 performs a note-on event producing process at step 1709.

FIG. 18 is a flow chart of an example of the note-on event producing process performed in the fourth embodiment. In the note-on event producing process shown in FIG. 18, the note-on event is sent from the performance apparatus 110 to the musical instrument unit 19, and then the sound generating process (refer to FIG. 7) is performed in the musical instrument unit 19, whereby musical tone data is generated and musical tones are output from the speaker 35.

Before describing the note-on event producing process, the sound-generation timing in the electronic musical instrument 10 of the present embodiment will be described. FIG. 19 is a graph that typically represents an acceleration-sensor value detected by the acceleration sensor 23 of the performance apparatus 110. When the player holds one end (the base) of the elongated performance apparatus 110 and swings the performance apparatus 110 down, the performance apparatus 110 rotates about a fulcrum at the player's wrist, elbow, or shoulder. Rotating motion of the performance apparatus 110 causes centrifugal force, yielding acceleration in the performance apparatus 110 in its axial direction.

When the player swings the performance apparatus 110 down, the acceleration value gradually increases (refer to Reference number 1901, a curve 1900 in FIG. 19). When the player swings down the elongated performance apparatus 110 of a stick type, in general, he or she moves his or her body as if he or she dubs or plays the drum. Therefore, the player stops his or her motion just before he or she strikes or hits the imaginary surface of the drum. Accordingly, the acceleration value begins to gradually decrease after such time (refer to Reference number 1902). The player supposes that musical tones will be generated at the time when the imaginary surface or head of the drum has been struck. Therefore, it is preferable to generate musical tones at the time when the player expects the sound is generated.

So as to make the electronic musical instrument generate musical tones at the time or just before the player strikes the imaginary surface of the drum, the present invention employs the following logic. It is assumed in the fourth embodiment that the sound-generation timing is specified by a time when the acceleration-sensor value decreases to a value less than the second threshold value β, which is slightly larger than "0". But the sound-generation timing can reach around the second threshold value β, because of fluctuation of the acceleration-sensor value due to unintentional motion of the player. Therefore, to avoid effects of the fluctuation of the acceleration-sensor value, a condition is set that requires the acceleration-sensor value to once increase to a value larger than the first threshold value α (the value of α is sufficiently larger than the value β). In other words, the sound-generation timing is defined by a time tβ when the acceleration-sensor value increases to a value larger than the first threshold value α (refer to a time tα in FIG. 8) and then has decreased to a value less than the second threshold value β (refer to a time tβ). When it is determined that the sound-generation timing has reached as described above, a note-on event is produced in the performance apparatus 110 and sent to the musical instrument unit 19. In response to the production of note-on event, the sound generating process is performed in the musical instrument unit 19 to generate musical tones.

Further, in the fourth embodiment is measured information of a time interval "T" between the time tα when the acceleration sensor value increases to a value larger than the first threshold value α and the time tβ when the acceleration sensor value thereafter decreases to a value less than the second threshold value β. And the sound volume level of a musical tone to be generated is determined based on the time interval information "T". Every time the sound-generation timing detecting process is performed after the acceleration sensor value increases larger than the first threshold value α, the timer value "t" is added to the time interval information "T" at step 1705 in FIG. 17. Therefore, when it is determined at step 1708 that the acceleration-sensor value is less than the second threshold value β (YES at step 1708), the time interval information "T" is obtained, which represent the time interval between the time tα and the time tβ in FIG. 19.

In the note-on event producing process shown in FIG. 18, CPU 21 refers to the time-interval information "T" stored in RAM 26 at step 1801 to determine a sound-volume level (velocity) of a musical tone to be generated.

When the maximum value of the sound volume level is denoted by Vmax, the sound volume level will be obtained as follows:

$$\mathrm{Vel}=a\cdot T,\ \text{where if } a\cdot T>V\mathrm{max},\ \mathrm{Vel}=V\mathrm{max},\ \text{"}a\text{" is a positive constant.}$$

Then, CPU 21 produces a note-on event containing the sound volume level at step 1802. The note-on event contains information of pitch and timbre. CPU 21 sends the produced note-on event to the infrared communication device 24 through L/F 27 at step 1803. The infrared communication device 24 sends an infrared signal of the note-on event to the infrared communication device 33 of the musical instrument unit 19. Thereafter, CPU 21 resets the acceleration flag in RAM 26 to "0" at step 1804. Further, CPU 21 resets the timer value "t" to "0" at step 1805, and makes the timer interruption ineffective at step 1806.

After the note-on event producing process of step 1709, CPU 21 resets the time-interval information "T" to "0" at step 1710. When it is determined NO at step 1707, CPU 21 also resets the time-interval information "T" to "0" at step 1710.

FIG. 20 is a graph of an example of the acceleration sensor value detected by the acceleration sensor 23, when the performance apparatus 110 is swung down by the player. As shown in FIG. 20, in the case (first example) the acceleration-sensor value is given by a curve 2000, the time-interval information is "T0", and in the case (second example) the acceleration sensor value is given by a curve 2001, the time-interval information is "T1". Since T0<T1, the sound-volume level in the second example is larger than the sound-volume level in the first example.

When the sound generation timing detecting process finishes at step 1603 in FIG. 6, CPU 21 performs the parameter communication process at step 1604.

In the fourth embodiment, the performance apparatus 110 extends in an elongated direction to be held by the player with his or her hand. The elongated performance apparatus 110 is provided with the acceleration sensor 23. CPU 21 of the performance apparatus 110 gives an instruction (note-on event) of generating a musical tone to the sound source unit 31. CPU 21 produces the note-on event, which has a sound-generation timing specified by the time when the acceleration-sensor value of the acceleration sensor 23 has decreased to a value less than the second threshold value β after increasing to a value larger than the first threshold value α, wherein the second threshold value β is less than the first threshold value α, and then gives the musical tone unit 19 the instruction of generating sounds. Therefore, the musical instrument unit 19 can generate musical tones at the moment the player strikes the imaginary surface or head of the drum.

In the fourth embodiment, the sound-volume level is determined based on the time interval between the time when the acceleration sensor value reaches the first level and the time when the acceleration-sensor value thereafter reaches a level (the second threshold value β is less than the first threshold value α) corresponding to the sound generation timing. Therefore, the musical instrument unit 19 can generate a musical tone of a sound volume determined depending on the manner in which the player swings the performance apparatus 110 down.

In the fourth embodiment, the time when the acceleration-sensor value reaches the first level is set to the time when the acceleration sensor value reaches the first threshold value, wherein at the latter time the detection of the sound-generation timing is triggered first time.

Therefore, it is possible to obtain the time-interval information with reference the time when the acceleration-sensor value is detected in the sound-generation timing detecting process.

For example, in the fourth embodiment, CPU 21 calculates the sound-volume level Vel based on the time-interval information "T" as follows:

$$\mathrm{Vel}=a\cdot T,\ \text{where if } a\cdot T\geq \text{the maximum value } V\mathrm{max} \text{ of the sound volume level, } \mathrm{Vel}=V\mathrm{max},\ \text{"}a\text{" is a positive constant.}$$

Therefore, the musical instrument unit 19 can generates musical tones having precise sound volumes depending on the manner in which the player swings the performance apparatus 110 down.

It will be understood that the present invention is not limited to these particular embodiments described herein, and numerous rearrangements, modifications, and substitutions may be made to the embodiments of the invention described herein without departing from the scope of the invention.

In the fourth embodiment, the time-interval information "T" is multiplied by a positive constant "a" to calculate the sound volume level, wherein the time-interval information "T" represents an interval between the time when the acceleration-sensor value reaches the first threshold value α and the time when the acceleration-sensor value thereafter reaches the second threshold value β. But the calculation of the sound-volume level is not limited to the above, and a modification may be made such that the sound-volume level is determined depending which range the time-interval information "T" belongs to.

The performance apparatus 110 in the other embodiment determines the sound-volume level at step 1801 as described below. In RAM 26 are store the table contains the ranges of the time-interval information "T" and the corresponding sound-volume levels. The table stores the following information:

$0<T\leq Tm1:Vel=V1$ $Tm1<T\leq Tm2:Vel=V2$ $Tm2<T\leq Tm3:Vel=V3$ $Tm3<T:Vel=Vmax$, where $V1<V2<V3<Vmax$.

For instance, Tm3 is 0.7 sec.

In the embodiment, CPU 21 obtains the sound-volume level depending which range in the table the time-interval information "T" belongs to. Therefore, an appropriate sound volume level can be obtained without operating multiplication.

In the embodiment, CPU 21 of the performance apparatus 110 detects an acceleration-sensor value caused when the player swings the performance apparatus 110 down, determining the timing of sound generation. CPU 21 of the performance apparatus 110 determines the sound-volume level of a musical tone to be generated in accordance with the time interval information "T" representing an interval between the time when the acceleration-sensor value reaches the first threshold value α and the time when the acceleration-sensor value thereafter reaches the second threshold value β. Then, CPU 21 of the performance apparatus 110 produces and sends the note-on event containing the sound volume level to the musical instrument unit 19 through I/F 27 and the infrared communication device 24 at the timing of the sound generation.

Further, in the embodiments, the infrared communication devices 24 and 33 are used to exchange an infrared signal of data between the performance apparatus 110 and the musical instrument unit 19, but the invention is not limited to the exchange of infrared signals. For example, modification may be made such that wireless communication and/or wire communication is used to exchange data between the performance apparatus 110 and the musical instrument unit 19.

What is claimed is:

1. A performance apparatus to be used with a musical-tone generating device for generating a musical tone, the performance apparatus comprising:

a holding member extending in a longitudinal direction to be held by a player;

an acceleration sensor provided in the holding member, for obtaining an acceleration-sensor value; and controlling means for giving the musical-tone generating device an instruction of generating a sound, wherein the controlling means comprises sound-generation timing detecting means for giving an instruction to the musical-tone generating device to generate a musical tone at a sound-generation timing represented by a time when the acceleration-sensor value obtained by the acceleration sensor has decreased to a value less than a second threshold value after increasing to a value larger than a first threshold value, wherein the second threshold value is less than the first threshold value.

2. The performance apparatus according to claim 1, further comprising:

a magnetic sensor provided in the holding member, for obtaining a magnetic sensor value; and difference calculating means for calculating based on the magnetic sensor value obtained by the magnetic sensor a difference value representing angles between a previously set reference orientation and an orientation of an axial direction of the holding member, wherein the controlling means comprises pitch determining means for determining based on the difference value calculated by the difference calculating means a pitch of a musical tone to be generated.

3. The performance apparatus according to claim 2, wherein the difference calculating means calculates based on the magnetic sensor value obtained by the magnetic sensor a discrepancy value θ representing angles between the magnetic north and the axial direction of the holding member, and further calculates a reference discrepancy value θp representing angles between the magnetic north and the axial direction of the holding member held at setting, wherein the reference discrepancy value θp represents the reference orientation, calculating a difference between the discrepancy value θ and the reference discrepancy value θp, wherein the calculated difference represents the difference value.

4. The performance apparatus according to claim 2, wherein the pitch determining means determines the pitch of a musical tone to be generated such that said pitch constantly increases or decreases as the difference value calculated by the difference calculating means increases.

5. The performance apparatus according to claim 1, further comprising:

a magnetic sensor provided in the holding member, for obtaining a magnetic sensor value; and difference calculating means for calculating based on the magnetic sensor value obtained by the magnetic sensor a difference value representing angles between a previously set reference orientation and an orientation of an axial direction of the holding member, wherein the controlling means comprises timbre determining means for determining based on the difference value calculated by the difference calculating means a timbre of a musical tone to be generated.

6. The performance apparatus according to claim 5, wherein the difference calculating means calculates based on the magnetic sensor value obtained by the magnetic sensor a discrepancy value θ representing angles between the magnetic north and the axial direction of the holding member, and further calculates a reference discrepancy value θp representing angles between the magnetic north and the axial direction of the holding member held at setting, wherein the reference discrepancy value θp represents the reference orientation, calculating a difference between the discrepancy value θ and the reference discrepancy value θp, wherein the calculated difference represents the difference value.

7. The performance apparatus according to claim 1, wherein the controlling means comprises sound-volume level calculating means for detecting the maximum value among the acceleration-sensor values obtained by the acceleration sensor and calculating a sound-volume level in accordance with the detected maximum value of the acceleration-sensor value, and the sound-generation timing detecting means gives an instruction to the musical-tone generating device to generate a musical tone of the sound-volume level calculated by the sound-volume level calculating means at the sound-generation timing.

8. The performance apparatus according to claim 7, wherein the sound-volume level calculating means calculates a sound-volume level Vel based on the detected maximum value Amax from the following equation:

$$Vel = a \cdot Amax, \text{ where if } a \cdot Amax \geq \text{the maximum sound-volume level } Vmax, Vel = Vmax, \text{ and "}a\text{" is a positive constant.}$$

9. The performance apparatus according to claim 7, further comprising:

a table containing ranges of the acceleration-sensor values and the sound-volume levels associated with the ranges respectively, wherein the sound-volume level calculating means obtains a sound-volume level based on which range in the table the maximum value Amax of the acceleration-sensor value belongs to.

10. The performance apparatus according to claim 1, wherein the controlling means further comprises sound-volume level calculating means for obtaining time-interval information representing an interval between the time when the acceleration-sensor value obtained by the acceleration sensor reaches a first predetermined level and the time when said acceleration-sensor value thereafter reaches the second threshold value, wherein the latter time corresponds to the sound-generation timing, and calculating a sound-volume level based on the obtained time-interval information, and the sound-generation timing detecting means gives an instruction to the musical-tone generating device to generate a musical tone of the sound-volume level calculated by the sound-volume level calculating means at the sound-generation timing.

11. The performance apparatus according to claim 10, wherein the sound-volume level calculating means obtains time-interval information representing an interval from the time when the acceleration-sensor value obtained by the acceleration sensor reaches the first threshold value representing the first predetermined level to the time when said acceleration-sensor value thereafter reaches the second threshold value.

12. The performance apparatus according to claim 10, wherein the sound-volume level calculating means calculates the sound-volume level Vel based on the obtained time-interval information "T" from the following equation:

$$\mathrm{Vel}=a\cdot T,\ \text{where if } a\cdot T\geq \text{the maximum sound-volume level } V\mathrm{max},\ \mathrm{Vel}=V\mathrm{max},\ \text{and "}a\text{" is a positive constant.}$$

13. The performance apparatus according to claim 1, further comprising:

a table containing ranges of the time-interval information and the sound-volume levels associated with the ranges respectively, wherein the sound-volume level calculating means obtains a sound-volume level based on which range in the table the time-interval information belongs to.

14. An electronic musical instrument comprising:

a musical instrument unit; and a performance apparatus, wherein the musical instrument unit comprises:

musical-tone generating device for generating musical tones, wherein the performance apparatus comprises:

a holding member extending in a longitudinal direction to be held by a player;

an acceleration sensor provided in the holding member, for obtaining an acceleration-sensor value; and controlling means for giving an instruction of generating a sound to the musical-tone generating device, wherein the controlling means comprises sound-generation timing detecting means for giving an instruction to the musical-tone generating device to generate a musical tone at a sound-generation timing represented by a time when the acceleration-sensor value obtained by the acceleration sensor has decreased to a value less than a second threshold value after increasing to a value larger than a first threshold value, wherein the second threshold value is less than the first threshold value, and wherein both the musical instrument unit and the performance apparatus comprise communication means, respectively.

* * * * *

UNITED STATES PATENT AND TRADEMARK OFFICE

CERTIFICATE OF CORRECTION

PATENT NO. : 8,653,350 B2
APPLICATION NO. : 13/118643
DATED : February 18, 2014
INVENTOR(S) : Takahiro Mizushina et al.

It is certified that error appears in the above-identified patent and that said Letters Patent is hereby corrected as shown below:

In the Specification, (Column 1, line 10),

"2010-120623" should be --2010-130623--.

Signed and Sealed this
Twenty-sixth Day of August, 2014

Michelle K. Lee

Michelle K. Lee
*Deputy Director of the United States Patent and Trademark Office*